US010338487B2

(12) United States Patent
Kamikura et al.

(10) Patent No.: US 10,338,487 B2
(45) Date of Patent: Jul. 2, 2019

(54) TONER

(71) Applicant: CANON KABUSHIKI KAISHA, Tokyo (JP)

(72) Inventors: Kenta Kamikura, Yokohama (JP); Kunihiko Nakamura, Gotemba (JP); Maho Tanaka, Tokyo (JP); Fumiya Hatakeyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/973,661

(22) Filed: May 8, 2018

(65) Prior Publication Data

US 2018/0329324 A1 Nov. 15, 2018

(30) Foreign Application Priority Data

May 15, 2017 (JP) ..... 2017-096354

(51) Int. Cl.
*G03G 9/097* (2006.01)
*G03G 9/08* (2006.01)
*G03G 9/087* (2006.01)

(52) U.S. Cl.
CPC ..... *G03G 9/0825* (2013.01); *G03G 9/0821* (2013.01); *G03G 9/0823* (2013.01); *G03G 9/08711* (2013.01); *G03G 9/08773* (2013.01); *G03G 9/09775* (2013.01)

(58) Field of Classification Search
CPC ..... G03G 9/08797; G03G 9/09307; G03G 9/09328
See application file for complete search history.

(56) References Cited

U.S. PATENT DOCUMENTS

| | | | |
|---|---|---|---|
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,828,639 | B2 | 9/2014 | Kamikura et al. |
| 8,986,914 | B2 | 3/2015 | Fujikawa et al. |
| 9,034,549 | B2 | 5/2015 | Shiotari et al. |
| 9,261,806 | B2 | 2/2016 | Moribe et al. |
| 9,285,697 | B2 | 3/2016 | Fukudome et al. |
| 9,423,708 | B2 | 8/2016 | Tominaga et al. |
| 9,594,323 | B2 | 3/2017 | Fujikawa et al. |
| 9,632,441 | B2 | 4/2017 | Abe et al. |
| 9,733,583 | B2 | 8/2017 | Kuroki et al. |

(Continued)

FOREIGN PATENT DOCUMENTS

| | | |
|---|---|---|
| JP | H08-184988 A | 7/1996 |
| JP | H08-292599 A | 11/1996 |

(Continued)

OTHER PUBLICATIONS

Translation of KR 1020140072439.*

(Continued)

*Primary Examiner* — Peter L Vajda
(74) *Attorney, Agent, or Firm* — Venable LLP

(57) ABSTRACT

A toner including: a toner particle including a toner base particle containing a binder resin, and an organosilicon condensate present on a surface of the toner base particle, wherein a charge attenuation constant of the toner is $3.5\times10^{-3}$ or more to $1.0\times10^{0}$ or less.

4 Claims, 1 Drawing Sheet

(56) References Cited

U.S. PATENT DOCUMENTS

| | | | | |
|---|---|---|---|---|
| 9,829,820 | B2 | 11/2017 | Masumoto et al. | |
| 9,880,478 | B2 | 1/2018 | Shimano et al. | |
| 9,897,933 | B2 | 2/2018 | Yoshida et al. | |
| 9,921,501 | B2 | 3/2018 | Mochizuki et al. | |
| 9,952,523 | B2 | 4/2018 | Shimano et al. | |
| 2009/0233200 | A1* | 9/2009 | Moriya | G03G 9/0823 430/108.1 |
| 2009/0246675 | A1 | 10/2009 | Nakamura et al. | |
| 2010/0028796 | A1 | 2/2010 | Nakamura et al. | |
| 2010/0183971 | A1 | 7/2010 | Fujikawa et al. | |
| 2016/0378003 | A1* | 12/2016 | Arimura | G03G 9/0819 430/110.1 |

FOREIGN PATENT DOCUMENTS

| | | | |
|---|---|---|---|
| JP | 2015-219388 | A | 12/2015 |
| JP | 2016-021041 | A | 2/2016 |
| JP | 2016-167018 | * | 9/2016 |
| JP | 2016-200815 | A | 12/2016 |
| KR | 1020140072439 | * | 6/2014 |

OTHER PUBLICATIONS

Translation of Abstract of JP 2016-167018.*
U.S. Appl. No. 15/969,318, Tsuneyoshi Tominaga, filed May 2, 2018.
U.S. Appl. No. 15/974,187, Sara Yoshida, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/974,969, Maho Tanaka, filed May 9, 2018.
U.S. Appl. No. 15/975,064, Kunihiko Nakamura, filed May 9, 2018.
U.S. Appl. No. 15/975,305, Kentaro Yamawaki, filed May 9, 2018.

* cited by examiner

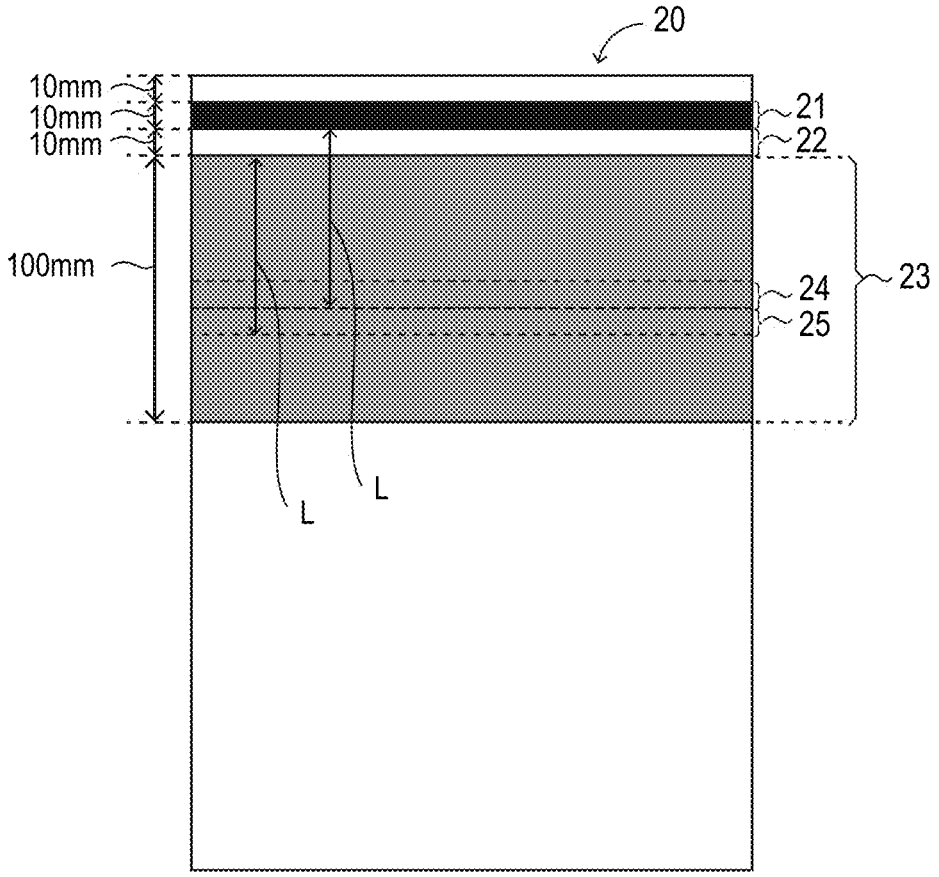
20
10mm
10mm
10mm
100mm
21
22
23
24
25
L
L

TONER

BACKGROUND OF THE INVENTION

Field of the Invention

The present disclosure relates to a toner for developing an electrophotograph and an electrostatic image (electrostatic latent image) to be used in an image forming method, such as an electrostatic printing method.

Description of the Related Art

In recent years, along with the development of computers or multimedia, environments in which an electrophotography type image forming method is used have diversified, and there is a need to output stable images for a long time even under severe environments such as a low temperature and low humidity environment or a high temperature and high humidity environment. To this end, a toner is required to exhibit stable chargeability even though it is used over a long period of time, and studies for improving durability and chargeability of the toner has been widely conducted.

In Japanese Patent Application Laid-Open No. 2016-021041, there is a disclosure of a toner having a condensate of an organosilicon compound having a specific structure in its surface layer in order to improve development durability and environmental stability of charging.

In Japanese Patent Application Laid-Open No. H08-184988, there is a disclosure of a toner in which alumina fine particles surface-treated with an organosilicon compound are externally added for suppressing overcharge in a low temperature and low humidity environment.

In Japanese Patent Application Laid-Open No. 2015-219388, there is a disclosure of a toner which has a surface layer made of a thermosetting resin such as a melamine resin, and of which a charge attenuation constant is controlled in order to suppress overcharge.

In Japanese Patent Application Laid-Open No. H08-292599, there is a disclosure of a toner in which a surface of a toner to which inorganic particles are fixed is coated with a silane coupling agent.

Since the toner disclosed in Japanese Patent Application Laid-Open No. 2016-021041 has a condensate of the organosilicon compound having high strength and high chargeability, the toner may have excellent development durability even in a low temperature and low humidity environment or a high temperature and high humidity environment. Further, the toner stably has high chargeability. However, since the condensate of the organosilicon compound has high resistance, in some cases, the toner may be over-charged in the lower temperature and low humidity environment. Overcharging of the toner sometimes causes adverse effects such as adhesion of the toner to a developing member or a carrier, such that there is room for improvement.

As a method of suppressing a toner from being overcharged, a method of adding the alumina fine particle surface-treated with the organosilicon compound from the outside to a toner has been suggested in Japanese Patent Application Laid-Open No. H08-184988. Further, a method of controlling a charge attenuation constant by forming the surface layer made of the thermosetting resin such as the melamine resin in the toner has been suggested in Japanese Patent Application Laid-Open No. 2015-219388. However, these toner particles do not have a condensate of an organosilicon compound, development durability or chargeability may be low. Further, performance to suppress over-charging may be insufficient as compared to that to be required.

As described in Japanese Patent Application Laid-Open No. H08-292599, the toner in which a surface of the toner to which an inorganic particle is fixed is coated with a silane coupling agent has also been investigated, but this toner may also have insufficient development durability and chargeability, and be overcharged in a low temperature and low humidity environment.

As described above, a toner having excellent development durability, high chargeability, and excellent overcharge suppression performance under a low temperature and low humidity environment has not been obtained, such that the toner should be improved.

The present disclosure has been made in view of the above problems, and an object of the present disclosure is to provide a toner having excellent development durability, high chargeability, and excellent overcharge suppression performance under a low temperature and low humidity environment.

SUMMARY OF THE INVENTION

To achieve the object, an aspect of the present disclosure relates to a toner including:

a toner particle including a toner base particle containing a binder resin, and an organosilicon condensate present on a surface of the toner base particle, wherein a charge attenuation constant of the toner is $3.5\times10^{-3}$ or more and $1.0\times10^{0}$ or less.

Further features of the present disclosure will become apparent from the following description of exemplary embodiments with reference to the attached drawings.

BRIEF DESCRIPTION OF THE DRAWINGS

FIGURE is a view for explaining each image portion formed on evaluation paper.

DESCRIPTION OF THE EMBODIMENTS

Hereinafter, an exemplary embodiment of the present disclosure will be described.

A toner according to the present disclosure is a toner including a toner particle including a toner base particle containing a base resin and an organosilicon condensate present on a surface of the toner base particle, wherein a charge attenuation constant of the toner is $3.5\times10^{-3}$ or more and $1.0\times10^{0}$ or less.

The present inventors have estimated that a factor in providing a toner having excellent development durability, high chargeability, and excellent overcharge suppression performance under a low temperature and low humidity environment with the above-mentioned configuration was as follows.

In a toner according to the related art, it is difficult to achieve both high chargeability and overcharge suppression performance. The reason is that since in the toner according to the related art, overcharge was suppressed by disposing an external additive or surface resin having low resistivity on an outermost surface of a toner particle and leaking charges to the outside of the toner using a leakage property thereof, a charge amount was also decreased at the same time.

Therefore, the present inventors thought that it can be possible to suppress overcharge while maintaining high chargeability by uniformly dispersing charges on a surface of a toner particle instead of leaking the charges to the outside of the toner particle.

Specifically, it is possible to suppress the charges from being leaked to the outside of the toner particle by forming an organosilicon condensate having high resistance on the surface of the toner base particle. Further, an excess charge may be uniformly dispersed on the surface of the toner particle by allowing the charge to easily move in the toner particle. Therefore, high chargeability and excellent overcharge suppression performance can be satisfied.

Specifically, the high chargeability and excellent overcharge suppression performance can be simultaneously satisfied by allowing the toner to have the organosilicon condensate on the surface of the toner base particle and controlling the charge attenuation constant of the toner to be $3.5\times10^{-3}$ or more and $1.0\times10^{0}$ or less. When the charge attenuation constant of the toner is less than $3.5\times10^{-2}$, it may be difficult to uniformly disperse the excess charge on the surface of the toner particle, such that the toner may be easily overcharged. Further, when the charge attenuation constant of the toner is more than $1.0\times10^{0}$, it may be difficult to maintain high chargeability of the toner. The charge attenuation constant of the toner may be preferably $5.0\times10^{-3}$ or more, and more preferably $1.0\times10^{-2}$ or more.

Next, the present disclosure will be described in more detail.

In the toner according to the present disclosure, when only some of the organosilicon condensates on the surface of the toner particle have an excess charge, the excess charge may be uniformly dispersed on the entire surface of the toner particle to allow the toner to be uniformly charged, thereby making it possible to suppress overcharge.

Here, a dispersion rate of the charge is inversely proportional to resistivity of materials present in the toner particle and is proportional to a cross-sectional area of a dispersion path of the charge. Therefore, there is a need to control resistivity of the materials configuring the toner particle and a contact area between each of the materials.

As a method of controlling the charge attenuation constant of the toner, for example, there are two methods. One method is to allow a toner particle to have inorganic fine particles each of which a surface is coated with an organosilicon condensate on a surface of the toner base particle. The other is to allow a toner particle to have resin fine particles having an organosilicon condensate on a surface thereof on a surface of the toner base particle, and allow the resin fine particles to include a resin having an ionic functional group.

In the first method, the inorganic fine particle of which the surface is coated with the organosilicon condensate is present on a surface of a toner base particle. It is preferable that the inorganic fine particle has volume resistivity of $1.0\times10^{5}$ (Ω·cm) or more and $1.0\times10^{11}$ (Ω·cm) or less. The inorganic fine particle of which the volume resistivity is in the above-mentioned range is a medium-resistance inorganic fine particle having resistance lower than that of a high-resistance inorganic fine particle such as a silica fine particle. The medium-resistance inorganic fine particle can be disposed in a sufficient contact area between the organosilicon condensate present on the surface of the toner base particle and the toner base particle by coating the surface of the medium-resistance inorganic fine particle with the organosilicon condensate. That is, it is thought that the organosilicon condensate is interposed between the medium-resistance inorganic fine particle and the toner base particle by coating the surface of the medium-resistance inorganic fine particle with the organosilicon condensate, such that adhesion between the medium-resistance inorganic fine particle and the toner base particle is improved, and thus, the sufficient contact area is obtained.

In a toner disclosed in Japanese Patent Application Laid-Open No. H08-292599, a toner particle is obtained by adding medium-resistance inorganic fine particles to a toner particle that does not have an organosilicon condensate on a surface thereof (hereinafter, referred to as a "toner base particle") from the outside and forming the organosilicon condensate on the surface thereof.

However, in the toner obtained by the method described above, a charge attenuation constant was out of the above-mentioned range (less than $5.0\times10^{-3}$), the effect of the present disclosure was not obtained. The reason may be that since affinity between the medium-resistance inorganic fine particle and the toner base particle is low, the medium-resistance inorganic fine particle and the toner base particle are not sufficiently adhered to each other, but there is a space between the medium-resistance inorganic fine particle and the toner base particle, such that a sufficient contact area is not secured. Therefore, it is estimated that dispersion of charges is inhibited, and the charge attenuation constant of the toner is out of the range.

Here, the medium-resistance inorganic fine particle used in the present disclosure will be described in detail.

<Medium-Resistance Inorganic Fine Particle>

Specifically, as the medium-resistance inorganic fine particle, an inorganic fine particle having volume resistivity of $1.0\times10^{5}$ (Ω·cm) or more and $1.0\times10^{11}$ (Ω·cm) or less may be preferably used. When the volume resistivity is within the above-mentioned range, it is easy to simultaneously satisfy excellent overcharge suppression performance and high chargeability.

Specific examples of the inorganic fine particle of which the volume resistivity is within the above-mentioned range are as follows:

fine particles of metal oxides represented by alumina (aluminum oxide: $Al_2O_3$), alumina hydrate, titania (titanium oxide: $TiO_2$), strontium titanate ($TiSrO_3$), zinc oxide (ZnO), tin oxide ($SnO_2$), iron oxides ($Fe_2O_3$, $Fe_3O_4$), indium oxide ($In_2O_3$), indium tin oxide, and the like;

fine particles of semiconductors represented by silicon, germanium, and the like; and clay minerals represented by hydrotalcite, and the like.

These fine particles may be surface-treated with a treating agent represented by a silane coupling agent, a titanate coupling agent, and silicon oil.

Among them, the alumina fine particle, the titania fine particle, and the strontium titanate fine particle are preferable, and the alumina fine particle is more preferable.

In the case of using the inorganic fine particle, a number-average particle diameter of a primary particle of the inorganic fine particles is preferably 3 nm or more and 500 nm or less, more preferably 5 nm or more and 200 nm or less. Since charges are easily dispersed when the number-average particle diameter is within the above-mentioned range, overcharge suppression performance may be further improved. Further, fluidity of the toner is improved unevenness formed on the surface of the toner particle. Therefore, the opportunity to charge the toner is increased, such that a charge rising property is improved.

It is preferable that a content of the inorganic fine particle is 0.01 to 5.0 parts by mass based on 100 parts by mass of the toner base particle. The content of the inorganic fine particle is preferably 0.02 to 2.0 parts by mass, and more preferably 0.03 to 2.0 parts by mass. The charge attenuation constant of the toner may be controlled by the volume resistivity and the content of the inorganic fine particle.

In the second method, resin fine particles having an organosilicon condensate are present on a surface of a toner base particle, and each of the resin fine particles contain a resin having an ionic functional group.

The resin fine particle generally has high volume resistivity, but in the resin fine particle containing the resin having the ionic functional group, the ionic functional group on the surface of the resin fine particle donates and accepts charges, such that the charges may be dispersed through the surface of the resin fine particle. Further, since the resin having the ionic functional group has high affinity with the organosilicon condensate, adhesion between the resin fine particle and the organosilicon condensate is easily improved. Therefore, it is easy to control the charge attenuation constant of the toner to fall within the above-mentioned range.

Further, affinity between the resin fine particle containing the resin having the ionic functional group and the toner base particle is high. Therefore, when the resin fine particle comes in direct contact with the toner base particle without intervention of the organosilicon condensate, adhesion between the resin fine particle and the toner base particle can be further increased, which is more preferable.

<Resin Fine Particle Containing Resin Having Ionic Functional Group>

Examples of the resin having the ionic functional group may include resins having ionic functional group among vinyl based resins, polyester resins, polyurethane resins, polyamide resins, and the like.

Examples of a polymerizable monomer capable of being used to synthesize the vinyl based resin are as follows:

styrene based monomers such as styrene and α-methylstyrene;

acrylic acid esters such as methyl acrylate and butyl acrylate;

methacrylic acid esters such as methyl methacrylate, 2-hydroxyethyl methacrylate, t-butyl methacrylate, and 2-ethylhexyl methacrylate;

unsaturated carboxylic acids such as acrylic acid, and methacrylic acid;

unsaturated dicarboxylic acids such as maleic acid;

unsaturated dicarboxylic acid anhydrides such as maleic acid anhydride;

nitrile based vinyl monomers such as acrylonitrile;

halogen-containing vinyl monomers such as vinyl chloride; and nitro based vinyl monomers such as nitrostyrene.

As the vinyl based resin, polymers or copolymers of these polymerizable monomers may be used.

Examples of the ionic functional group may include an acidic functional group such as a sulfo group, a carboxyl group, a phenolic hydroxyl group, and the like; and a basic functional group such as an amino group, and a quaternary ammonium group.

It is preferable to use a resin having the sulfo group or the carboxylic group among them. Since the sulfo group and the carboxylic group have excellent chargeability, chargeability of the toner may be further improved.

It is preferable that a number-average particle diameter of the resin fine particles containing the resin having the ionic functional group is 10 nm or more and 500 nm or less. When the number-average particle diameter of the resin fine particles falls within the above-mentioned range, charge dispersibility is excellent, and overcharge suppression performance is further improved.

A content of the resin fine particle containing the resin having the ionic functional group is preferably 0.1 to 15.0 parts by mass based on 100 parts by mass of the toner base particle. More preferably, the content of the resin fine particle is 0.1 to 5.0 parts by mass.

The charge attenuation constant of the toner may be controlled by an addition amount of the resin fine particle containing the resin having the ionic functional group.

Next, a preparation method of the resin fine particle containing the resin having the ionic functional group used in the present disclosure will be described in detail.

<Preparation Method of Resin Fine Particle>

A preparation method of the resin fine particle is not particularly limited, but a method known in the art can be used. For example, an emulsion polymerization method, a soap-free emulsion polymerization method, a phase-transfer emulsification method, a mechanical emulsification method, and the like, may be used.

Among them, a resin fine particle obtained in an aqueous medium is preferable. Since the ionic functional group is oriented on the surface of the particle by obtaining the resin fine particle in the aqueous medium, it is possible to more efficiently donate and accept charges, and overcharge suppression performance may be further improved.

Continuously, the organosilicon condensate will be described in detail.

<Organosilicon Compound>

The organosilicon condensate is present on the surface of the toner base particle. It is preferable that the organosilicon condensate is a condensate of organosilicon compounds represented by the following Formula (1). A combination of two or more kinds of organosilicon compounds may be used as long as the organosilicon compounds are compounds represented by Formula (1).

$$(Ra)_n—Si—(Rb)_{4-n} \quad (1)$$

In Formula (1), Ra indicates a halogen atom, a hydroxy group, or an alkoxy group, and Rb indicates an alkyl group, an alkenyl group, an aryl group, an acyl group, an acryloxyalkyl group, or a methacryloxyalkyl group. n indicates an integer of 2 to 4. However, when there are a plurality of Ra and Rb, the plurality of Ra and the plurality of Rb may be the same as or different from each other. More preferably, Ra is a halogen atom or an alkoxy group.

In Formula (1), the number of carbon atoms in the alkyl group is preferably 1 or more and 12 or less, and more preferably to 1 or more and 6 or less.

The number of carbon atoms in the alkenyl group is preferably 2 or more and 6 or less, and more preferably to 2 or more and 4 or less.

The number of carbon atoms in an acyl group is preferably 1 or more and 7 or less, and more preferably to 1 or more and 5 or less.

The aryl group is preferably a phenyl group or a naphthyl group, and more preferably, the phenyl group.

The number of carbon atoms of an alkyl group in the acryloxyalkyl group is preferably 1 or more and 6 or less. More preferably, the alkyl group is a propyl group.

The number of carbon atoms of an alkyl group in the methacryloxyalkyl group is preferably 1 or more and 6 or less. More preferably, the alkyl group is a propyl group.

The number of carbon atoms in the alkoxy group is preferably 1 or more and 6 or less, and more preferably to 1 or more and 4 or less.

Hereinafter, Ra in Formula (1) will be referred to as a functional group, and Rb in Formula (1) will be referred to as a substituent.

As the organosilicon compound represented by Formula (1), an organosilicon compound known in the art can be used without particular limitation. Specific examples thereof may include bifunctional, trifunctional, and tetrafunctional silane compounds having two, three, and four of the following functional groups, respectively.

Examples of the bifunctional silane compound may include dimethyldimethoxysilane, dimethyldiethoxysilane, and the like.

Examples of the trifunctional silane compound are as follows:

a trifunctional silane compound having an alkyl group as a substituent such as methyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, decyltrimethoxysilane, or decyltriethoxysilane;

a trifunctional silane compound having an alkenyl group as a substituent such as vinyltrimethoxysilane, vinyltriethoxysilane, allyltrimethoxysilane, or allyltriethoxysilane;

a trifunctional silane compound having an aryl group as a substituent such as phenyltrimethoxysilane, or phenyltriethoxysilane;

a trifunctional silane compound having a acryloxyalkyl group as a substituent such as γ-acryloxypropyltrimethoxysilane, γ-acryloxypropyltriethoxysilane, γ-acryloxypropyldiethoxymethoxysilane, or γ-acryloxypropylethoxydimethoxysilane; and a trifunctional silane compound having a methacryloxyalkyl group as a substituent such as γ-methacryloxypropyltrimethoxysilane, γ-methacryloxypropyltriethoxysilane, γ-methacryloxypropyldiethoxymethoxysilane, or γ-methacryloxypropylethoxydimethoxysilane.

Examples of the tetrafunctional silane compound may include tetramethoxysilane, tetraethoxysilane, tetrapropoxysilane, tetrabutoxysilane, and the like.

Among them, the organosilicon compound represented by Formula (1) may be preferably a compound represented by the following Formula (2).

$$(Ra)_3—Si—(Rb)_1 \quad (2)$$

In Formula (2), Ra indicates a halogen atom, a hydroxy group, or an alkoxy group, and Rb indicates an alkyl group, an alkenyl group, an aryl group, an acyl group, an acryloxyalkyl group, or a methacryloxyalkyl group. However, Ra may be equal to or different from each other.

Since the compound represented by Formula (2) has a suitable cross-linking property, the compound has flexibility at an initial stage of condensation and be hardened with the progress of condensation. Therefore, the compound can be firmly filled between the inorganic fine particle or the resin fine particle and the resin of the toner base particle at the initial stage of the condensation, and firmly adhere the inorganic fine particle or the resin fine particle and the resin of the toner base particle to each other with the progress of the condensation. Therefore, overcharge suppression performance is excellent.

Further, as described above, the compound represented by Formula (2) has the cross-linking property, development durability is excellent. In addition, since condensation causes hydrophobization, an organosilicon condensate having a high degree of hydrophobization can be obtained. Therefore, high chargeability is obtained even under a high temperature and high humidity environment, which is preferable.

In Formula (2), Rb is preferably an alkyl group having 1 to 6 carbon atoms, an alkenyl group having 1 to 6 carbon atoms, a phenyl group, acryloxyalkyl group, or a methacryloxypropyl group. When Rb is the above-mentioned functional group, it is easy to decrease surface free energy of the surface of the toner particle, and fluidity of the toner is improved. Therefore, an opportunity to charge the toner is increased and the charge rising property is improved. Further, a silicon atom, which is a charged site, easily accepts charges, such that chargeability is further improved.

A content of the organosilicon condensate is preferably 0.2 to 20.0 parts by mass, more preferably 0.5 to 10.0 parts by mass, and further more preferably, 2.0 to 10.0 parts by mass based on 100 parts by mass of the toner base particle. When the content falls within the above-mentioned range, the toner is hardly deteriorated even in the case of using the toner for a long period of time, and good chargeability can be maintained.

Subsequently, a preparation method of the toner particle will be described in detail below.

<Preparation Method of Toner Particle Including Medium-Resistance Inorganic Fine Particle>

In a case of preparing the toner particle including the medium-resistance inorganic fine particles according to the present disclosure, it is preferable to prepare the toner particle using the following first or second preparation method.

As the first preparation method, there is a method including a step of preparing a mixed solution containing an organosilicon compound represented by Formula (1) or a hydrolysate thereof, the medium-resistance inorganic fine particles, and the toner base particles in an aqueous medium and a step of condensing the organosilicon compound.

The organosilicon compound can be added to and mixed with the aqueous medium by any method. The organosilicon compound may be added as it is, but it is preferable that the organosilicon compound is added after being mixed with the aqueous medium to thereby be hydrolyzed.

It is known that hydrolysis and condensation reactions of the organosilicon compound has pH dependency, and it is preferable that in the hydrolysis reaction, a pH is 2.0 or more and 7.0 or less, and in the condensation reaction, a pH of the aqueous medium is 7.0 or more and 12.0 or less.

The pH of the aqueous medium or the mixed solution may be adjusted by an existing acid or base. Examples of the acid for adjusting the pH are as follows:

hydrochloric acid, bromic acid, iodic acid, perchloric acid, perbromic acid, meta-periodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, asparaginic acid, o-aminobenzoic acid, p-aminobenzoic acid, isonicotinic acid, oxalacetic acid, citric acid, 2-glycerophosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, and malonic acid.

Examples of the base for adjusting the pH are as follows:

alkali metal hydroxides such as potassium hydroxide, sodium hydroxide, and lithium hydroxide, and aqueous solutions thereof; alkali metal carbonates such as potassium carbonate, sodium carbonate, and lithium carbonate, and aqueous solutions thereof; alkali metal sulfates such as potassium sulfate, sodium sulfate, and lithium sulfate, and aqueous solutions thereof; alkali metal phosphates such as potassium phosphate, sodium phosphate, and lithium phosphate, and aqueous solutions thereof; alkali earth metal hydroxides such as calcium hydroxide, magnesium hydroxide, and aqueous solutions thereof; ammonia; basic amino acids such as histidine, arginine, lysine, and aqueous solutions thereof; and trishydroxymethylaminomethane.

One of these acids and bases may be used alone, or a combination of two or more thereof may be used.

The medium-resistance inorganic fine particle may be used as it is. Alternatively, water dispersion of the medium-resistance inorganic fine particles is prepared in advance and then, the water dispersion may be used. The mixed solution may be prepared using any mixing unit.

A process of dispersing the medium-resistance inorganic fine particles in the mixed solution may also be performed.

The medium-resistance inorganic fine particles can be attached to the toner base particle in a state in which it is more uniformly dispersed by uniformly dispersing the medium-resistance inorganic fine particles.

The medium-resistance inorganic fine particles can be dispersed using a high-pressure homogenizer, a rotating shear-type homogenizer, an ultrasonic wave disperser, and a high-pressure impact disperser, or the like.

Here, the mechanism by which the adhesion of the medium-resistance inorganic fine particles to the toner base particle can be improved in the case of performing the condensation reaction of the organosilicon compound using the hydrolyzed organosilicon compound may be as follows.

At the time of condensation of the hydrolyzed organosilicon compound, the organosilicon condensate adheres to the surface of the medium-resistance inorganic fine particles in a state in which stability thereof with respect to the aqueous medium is decreased.

A condensation reaction of the organosilicon condensate attached to the surface of the medium-resistance inorganic fine particles is carried out again. As the condensation reaction is carried out, the organosilicon condensate is further hydrophobized due to an influence of Si atoms. That is, the surface of the medium-resistance inorganic fine particles are coated with the hydrophobized organosilicon condensate.

The medium-resistance inorganic fine particles coated with the hydrophobized organosilicon condensate are difficult to stably exist in an aqueous medium, such that the inorganic fine particle is buried in the toner base particle in order to remove the surface thereof in the aqueous medium. In this case, since the organosilicon condensate serves as an adhesive at interfaces between the medium-resistance inorganic fine particles and the toner base particle, the medium-resistance inorganic fine particles and the toner base particle may be firmly adhered to each other. In addition, since the organosilicon condensate is interposed between the medium-resistance inorganic fine particle and the toner base particle, a sufficient contact area is secured between the medium-resistance inorganic fine particle and the toner base particle, such that the toner having excellent charge dispersibility can be obtained.

Here, it is preferable that a temperature at the time of the condensation reaction is adjusted to be equal to or higher than a glass transition temperature (Tg) of the toner base particle. Specifically, the temperature is preferably equal to or more than the glass transition temperature (Tg) of the toner base particle but not more than the glass transition temperature+40° C. More preferably, the temperature is equal to or more than the glass transition temperature (Tg) of the toner base particle but not more than the glass transition temperature+30° C.

As the second preparation method, there is a method including a step of preparing a mixed solution containing the organosilicon compound represented by Formula (1) or a hydrolysate thereof, the medium-resistance inorganic fine particles, and a precursor of the toner base particle in an aqueous medium and a step of condensing the organosilicon compound.

Examples of the precursor of the toner base particle can include polymerizable monomers capable of forming a binder resin. Further, polymerization of the precursor of the toner base particle and condensation of the organosilicon compound can be simultaneously carried out or separately carried out.

In the second preparation method, adhesion of the medium-resistance inorganic fine particles to the toner base particle is improved in the same manner as that in the first preparation method. In addition, since the organosilicon condensate is interposed between the medium-resistance inorganic fine particle and the precursor of the toner base particle, a sufficient contact area is secured between the medium-resistance inorganic fine particle and the precursor of the toner base particle, such that a toner having excellent charge dispersibility can be obtained.

<Preparation Method of Toner Particle Including Resin Fine Particle Containing Resin Having Ionic Functional Group>

In the case of preparing the toner particle including resin fine particles containing a resin having an ionic functional group, a method having the following adhesion process and condensation process is preferably used.

The adhesion process is a process of preparing a dispersion containing the toner base particles and the resin fine particles containing a resin having an ionic functional group and adhering the resin fine particles containing the resin having the ionic functional group to the toner base particle. As a method of adhering the resin fine particles to the toner base particle, there are a method of applying mechanical impact to the dispersion to bury the resin fine particles in the toner base particle and a method of heating an aqueous medium to adhere the resin fine particles to the toner base particle. Further, a method of adding a coagulant to adhere the resin fine particles to the toner base particle may be used. Alternatively, a combination of these methods may be used. In any of the methods, it is preferable to stir the aqueous medium.

In view of increasing a contact area between the resin fine particle containing the resin having the ionic functional group and the toner base particle, a method of heating the aqueous medium to be equal to or higher than the glass transition temperature (Tg) of the toner base particle is more preferable. By heating the aqueous medium to be equal to or higher than the glass transition temperature, the resin fine particles containing the resin having the ionic functional group and the toner base particle can be integrated with each other when the toner base particle is softened and thus the resin fine particles containing the resin having the ionic functional group come in contact with the toner base particle.

It is preferable to adhere the resin fine particles containing the resin having the ionic functional group and the toner base particle to each other by adjusting the pH so that the resin fine particles containing the resin having the ionic functional group are easily dispersed in the aqueous medium and heating the aqueous medium in a state in which the resin fine particles containing the resin having the ionic functional group and the toner base particles coexist in the aqueous medium. The resin fine particles containing the resin having the ionic functional group can be adhered to the toner base particle in a state in which the resin fine particles are dispersed by this method, and the toner base particles are hard to aggregate.

The condensation process is a process of adding the organosilicon compound or the hydrolysate thereof to the dispersion and condensing the organosilicon compound in the dispersion to obtain the organosilicon condensate. As a condensation method, there is a method of preparing a mixed solution containing the organosilicon compound or the hydrolysate thereof and a toner base particle to which resin fine particles containing a resin having ionic functional group are adhered in an aqueous medium, and condensing the organosilicon compound.

The organosilicon compound can be added to and mixed with the aqueous medium by any method. The organosilicon compound may be added as it is, but it is preferable that the organosilicon compound is mixed with the aqueous medium to thereby be hydrolyzed, and then added. It is preferable to control a pH in hydrolysis and condensation reactions of the organosilicon compound using a method similar to that in the first preparation method described above.

A pH of the aqueous medium or mixed solution may be adjusted using an existing acid or base. Examples of an acid and a base for adjusting the pH may include above-mentioned acids and bases.

<Preparation Method of Toner Base Particle>

A preparation method of the toner base particle is not particularly limited, but a suspension polymerization method, a dissolution suspension method, an emulsion aggregation method, a pulverization method, or the like, may be used. When the toner base particles are prepared in the aqueous medium, the resultant can be used as a water dispersion as it is. Alternatively, the resultant may also be washed, filtered, or dried, and then re-dispersed in the aqueous medium.

When the toner base particles are prepared in a dry state, the toner base particles can be dispersed in an aqueous medium by a method known in the art. In order to disperse the toner base particles in the aqueous medium, it is preferable that the aqueous medium contains a dispersion stabilizer.

Hereinafter, a preparation method of the toner base particle using the suspension polymerization method will be described.

First, a polymerizable monomer composition in which polymerizable monomers capable of forming a binder resin, and if necessary various materials are added and dissolved or dispersed using a disperser is prepared. Examples of the various materials may include a colorant, wax, a charge control agent, a solvent for adjusting a viscosity, a crystalline resin, a polymerization initiator, a chain transfer agent, and the like. An Example of the disperser includes a homogenizer, a ball mill, a colloid mill, or an ultrasonic wave disperser.

Next, the polymerizable monomer composition is injected into an aqueous medium containing a water-insoluble inorganic fine particles and droplets of the polymerizable monomer composition are prepared using a high-speed stirrer or a high-speed disperser such as an ultrasonic wave disperser, (granulation process).

Thereafter, the polymerizable monomers in the droplets are polymerized, thereby obtaining the toner base particles (polymerization process).

The polymerization initiator may be mixed when the polymerizable monomer composition is prepared, or may also be mixed into the polymerizable monomer composition immediately before the droplets are formed in the aqueous medium. Further, the polymerization initiator can be added during the granulation of the droplets or after the completion of the granulation, that is, just before the start of the polymerization reaction in a state in which the polymerization initiator is dissolved in the polymerizable monomers or another solvent as needed. After polymerizing the polymerizable monomers to obtain the resin particles, it is preferable to obtain a dispersion of the toner base particles by performing desolvation treatment as needed.

Subsequently, other materials used in the toner particle will be described in detail below.

<Other Fine Particles>

In addition to the medium-resistance inorganic fine particle or the resin fine particle described above, another fine particle may be simultaneously used in the toner particle.

Specifically, among the following fine particles, a fine particle having a volume resistivity of less than $1.0\times10^{5}$ (Ω·cm) or a fine particle having a volume resistivity exceeding $1.0\times10^{11}$ (Ω·cm) can be used:

silica fine particles represented by water-glass silica (silicon oxide: $SiO_2$), sol-gel silica, dry process silica, and the like;

fine particles of semiconductors represented by silicon, germanium, and the like; and clay minerals represented by hydrotalcite, and the like.

These fine particles may be surface-treated with a treating agent represented by a silane coupling agent, a titanate coupling agent, and silicon oil.

It is preferable to simultaneously use fine particles having volume resistivity exceeding $1.0\times10^{11}$ (Ω·cm) among them. A charge amount of the toner can be further increased by simultaneously using the fine particles having volume resistivity exceeding $1.0\times10^{11}$ (Ω·cm). As the fine particle having volume resistivity exceeding $1.0\times10^{11}$ (Ω·cm), the silica fine particle is preferable. The toner particle may additionally have the silica fine particles of which a surface is coated with the organosilicon condensate on the surface of the toner base particle by using the silica fine particles.

<Binder Resin>

Examples of the binder resin constituting the toner base particle may include a vinyl based resin, a polyester resin, a polyurethane resin, a polyamide resin, and the like. Among them, the vinyl based resin is preferable.

Examples of the vinyl based resin may include polymers or copolymers of the following monomers. Among them, a copolymer of a styrene based monomer and unsaturated carboxylic acid ester is preferable.

Styrene based monomers such as styrene, and α-methylstyrene; acrylic acid esters such as methyl acrylate and butyl acrylate; methacrylic acid esters such as methyl methacrylate, 2-hydroxyethyl methacrylate, t-butyl methacrylate, and 2-ethylhexyl methacrylate; unsaturated carboxylic acids such as acrylic acid, and methacrylic acid; unsaturated dicarboxylic acid such as maleic acid; unsaturated dicarboxylic acid anhydrides such as maleic acid anhydride; nitrile based vinyl monomers such as acrylonitrile; halogen-containing vinyl monomers such as vinyl chloride; and nitro based vinyl monomers such as nitrostyrene.

In addition, it is preferable that the toner base particle further contains a resin having ionic functional group. Since the resin having the ionic functional group has high affinity with the organosilicon condensate, the resin is easily coated with the organosilicon condensate, and a leakage of the charge to the outside of the toner can be further suppressed. Therefore, higher chargeability can be obtained.

<Polymerization Initiator>

As the polymerization initiator, any polymerization initiator can be used without limitation as long as it is known in the art.

Specific examples thereof are as follows:

peroxide based polymerization initiators represented by hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxy carbonate, tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, N-(3-toluoyl)perpalmitate-tert-butyl benzoylperoxide, t-butyl peroxy 2-ethylhexanoate, t-butyl peroxypivalate, t-butylperoxy isobutyrate, t-butylperoxy neodecanoate, methylethylketone peroxide, diisopropyl peroxycarbonate, cumen hydroperoxide, 2,4-dichlorobenzoyl peroxide, and the like; and azo or diazo based polymerization initiators represented by 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile, and the like.

<Colorant>

As the colorant contained in the toner base particle, pigments, dyes, and magnetic materials having black, yellow, magenta, and cyan colors known in the art, or having other colors can be used without particular limitation.

As a specific example of a black colorant, a black pigment represented by carbon black, or the like, is used.

Specific examples of a yellow colorant are as follows:

Yellow pigments and yellow dyes represented by a monoazo compound; a disazo compound; a condensed azo compound; an isoindolinone compound; a benzimidazolone compound; an anthraquinone compound; an azo metal complex; a methine compound; an allylamide compound, and the like. Specifically, C.I. pigment yellow 74, 93, 95, 109, 111, 128, 155, 174, 180, and 185, C.I. solvent yellow 162, and the like may be used.

Specific examples of a magenta colorant are as follows:

magenta pigments and magenta dyes represented by a monoazo compound; a condensed azo compound; a diketopyrrolopyrrole compound, an anthraquinone compound, a quinacridone compound, a lake compound of basic dyes, a naphthol compound, a benzimidazolone compound, a thioindigo compound, and a perylene compound. Specifically, C.I. pigment red 2, 3, 5, 6, 7, 23, 48:2, 48:3, 48:4, 57:1, 81:1, 122, 144, 146, 150, 166, 169, 177, 184, 185, 202, 206, 220, 221, 238, 254, and 269, C.I. pigment violet 19, or the like, may be used.

Specific examples of a cyan colorant may include cyan pigments and cyan dyes represented by the following copper phthalocyanine compound and derivatives thereof, an anthraquinone compound; a lake compound of a basic dye, and the like. Specifically, the following C.I. pigment blue 1, 7, 15, 15:1, 15:2, 15:3, 15:4, 60, 62, and 66, and the like, may be used.

It is preferable that a content of the colorant is 1.0 to 20.0 parts by mass based on 100 parts by mass of the binder resin or the polymerizable monomer.

A magnetic material can be contained in the toner base particle, such that the toner can be used as a magnetic toner. In this case, the magnetic material may also serve as a colorant.

Specific examples of the magnetic material are as follows:

iron oxides represented by magnetite, hematite, and ferrite; and metals such as iron, cobalt, and nickel, or alloys of these metals and metals such as aluminum, cobalt, copper, lead, magnesium, tin, zinc, antimony, beryllium, bismuth, cadmium, calcium, manganese, selenium, titanium, tungsten, or vanadium, mixtures thereof, and the like.

<Wax>

Specific examples of the wax contained in the toner base particle are as follows: esters of monohydric alcohols and aliphatic monocarboxylic acids or esters of monovalent carboxylic acids and aliphatic monoalcohols, such as behenyl behenate, stearyl stearate and palmityl palmitate;

esters of dihydric alcohols and aliphatic monocarboxylic acids or esters of divalent carboxylic acids and aliphatic monoalcohols, such as dibehenyl sebacate and hexanediol dibehenate;

esters of trihydric alcohols and aliphatic monocarboxylic acids or esters of trivalent carboxylic acids and aliphatic monoalcohols, such as glycerin tribehenate;

esters of tetrahydric alcohols and aliphatic monocarboxylic acids or esters of tetravalent carboxylic acids and aliphatic monoalcohols, such as pentaerythritol tetrastearate and pentaerythritol tetrapalmitate;

esters of hexahydric alcohols and aliphatic monocarboxylic acids or esters of hexavalent carboxylic acids and aliphatic monoalcohols, such as dipentaerythritol hexastearate and dipentaerythritol hexapalmitate;

esters of polyhydric alcohols and aliphatic monocarboxylic acids or esters of polyvalent carboxylic acids and aliphatic monoalcohols, such as polyglycerin behenate;

natural ester waxes such as carnauba waxes and rice wax;

petroleum based wax and derivatives thereof such as paraffin wax, microcrystalline wax, and petrolatum;

hydrocarbon wax and derivatives thereof by Fischer-Tropsch method; and polyolefin wax such as polyethylene wax and polypropylene wax and derivatives thereof; fatty acids such as higher aliphatic alcohols, stearic acid, and palmitic acid; and acid amide wax.

It is preferable that a content of the wax is 1.0 to 30.0 parts by mass based on 100 parts by mass of the binder resin or the polymerizable monomer. It is more preferable that the content is 5.0 to 20.0 parts by mass.

<Charge Control Agent>

The toner base particle may further contain the charge control agent.

As the charge control agent, an existing charge control agent known in the art may be used without particular limitation. Specifically, examples of a negative charge control agent are as follows:

metal compounds of aromatic carboxylic acids such as salicylic acid, alkyl salicylic acid, dialkylsalicylic acid, naphthoic acid, and dicarboxylic acid, or polymers or copolymers having the metal compounds of these aromatic carboxylic acids;

polymers or copolymers having a sulfonic acid group, a sulfonate group, or a sulfonic acid ester group;

metal salts or metal complexes of azo dyes or azo pigments; and boron compounds, silicon compounds, calixarene, and the like.

Further, examples of a positive charge control agent are as follows:

quaternary ammonium salts; polymeric compounds having quaternary ammonium salts in a side chain; guanidine compounds; nigrosine compounds; imidazole compounds, and the like.

Further, as the polymer or copolymer having the sulfonate group or sulfonic acid ester group, the following polymer or copolymer can be used.

Homopolymers of vinyl based monomers containing a sulfonic acid group such as styrene sulfonic acid, 2-acrylamide-2-methylpropane sulfonic acid, 2-methacrylamide-2-methylpropane sulfonic acid, vinylsulfonic acid, acrylsulfonic acid, or methacrylsulfonic acid, or copolymer of the vinyl based monomer described in the binder resin section and the vinyl based monomer containing the sulfonic acid group may be used.

It is preferable that a content of the charge control agent is 0.01 to 5.0 parts by mass based on 100 parts by mass of the binder resin or the polymerizable monomer.

<External Additive>

The toner particle has the organosilicon condensate on the surface thereof, such that the toner exhibits characteristics such as excellent fluidity even in a case in which an external additive is not present in toner. However, in order to further improve the characteristics of the toner, the toner can contain the external additive.

As the external additive, an existing external additive known in the art may be used without particular limitation. Specific examples thereof are as follows:

raw silica fine particles such as wet process silica, dry process silica; or silica fine particles obtained by surface treating the raw silica fine particles with a treating agent such as a silane coupling agent, a titanium coupling agent, and silicon oil;

metal oxide fine particles such as a titanium oxide fine particle, an aluminum oxide fine particle, a zinc oxide fine particle, a strontium titanate fine particle or metal oxide fine particles obtained by performing hydrophobic treatment on these metal oxides;

fatty acid metal salts such as zinc stearate and calcium stearate;

metal complexes of aromatic carboxylic acids such as salicylic acid, alkylsalicylic acid, dialkylsalicylic acid, naphthoic acid, and dicarboxylic acid; clay minerals such as hydrotalcite; and resin fine particles such as vinylidene fluoride fine particles and polytetrafluoroethylene fine particle.

When the toner particle contains the external additive, a content of the external additive is preferably 0.1 to 5.0 parts by mass based on 100 parts by mass of the toner particle.

Subsequently, hereafter, a measurement method of the toner according to the present disclosure will be described.

<Measurement of Charge Attenuation of Toner and Calculation of Charge Attenuation Constant>

The charge attenuation constant of the toner is calculated as described below using a corona charge device KTK-2001 attached to a thermal stimulation current measurement system (product name: TS-POLAR, manufactured by Rigaku Corp.) and a surface potential meter (trade name: Model 347, manufactured by TREK Inc.). Here, a case of a negatively charged toner will be described. In a positively charged toner, all polarity settings need to be reversed.

(1) Setting of Sample Holder (1-1) An attached sample holder is set in a sample part of a main body of the thermal stimulation current measurement system, and a holder guide is closed.

(1-2) A probe of the surface potential meter is installed in a surface potential meter installation part of the corona charge device.

(1-3) The surface potential meter is turned on, the sample holder is moved to a lower portion of the surface potential meter, and a surface potential is set to 0.0 V by turning a Zero Adjust knob of the surface potential meter. Here, an interval between the sample holder and the surface potential meter is set to 3 mm.

(2) Setting of Sample (2-1) 700 mg of the toner is weighed on a sample pan (made of aluminum) and put on the sample holder.

(2-2) The sample is moved to a lower portion of a corona electrode by rotating a turn table, and a cover is closed.

(3) Charging (3-1) A high-voltage cable is inserted into a minus (−) side of a polarity switching connector on the grid side and the corona side (a dummy connector is inserted into a plus (+) side of the polarity switching connector).

(3-2) A polarity switching switch on the grid side and the corona side is turned to the minus (−) side and the corona charge device is turned on.

(3-3) A high-voltage ON switch on the grid side is pressed, and a grid voltage adjustment dial is turned, thereby setting a grid side voltage to 1 kV.

(3-4) A high-voltage ON switch on the corona side is pressed, and a corona voltage adjustment dial is turned, thereby setting a corona side voltage to 20 kV.

(3-5) The sample is charged for 30 seconds in this state.

(4) Measurement of Potential (4-1) The sample is moved to a lower portion of the probe of the surface potential meter by rotating the turn table. This time is set as a measurement start time.

(4-2) In this state, a surface potential is measured for 1800 seconds. A surface potential at 900 seconds after the start of measurement is set to an initial surface potential $V_0$, and a charge attenuation constant is calculated according to the following Equation (3) from surface potential transition from 900 seconds to 1800 seconds.

$$V=V_0\exp(-\alpha\sqrt{t}) \quad (3)$$

(In Equation (3), V is a surface potential (V), $V_0$ is the initial surface potential (V), $\alpha$ is the charge attenuation constant, and t is an attenuation time (seconds).)

<Observation of Cross Section of One Particle of Toner Using Transmission Electron Microscope (TEM)>

A cross section of one particle of the toner is observed by the following method.

After sufficiently dispersing the toner in a visible light-curable embedding resin (trade name: D-800, manufactured by Toagosei Co., Ltd.), the visible light-curable embedded resin is irradiated with visible light using a light irradiator (trade name: LUXSPOT II, JEOL Ltd.), thereby obtaining a cured product. A flaky sample is cut out of the obtained cured product with a microtome equipped with a diamond blade. This sample is enlarged at a magnification of 100,000 with a transmission electron microscope (TEM) (trade name: JEM2800, manufactured by JEOL Ltd.) at an acceleration voltage of 200 kV, and a cross section of one particle of the toner is observed. Elemental analysis is performed by mapping each element using energy dispersive X-ray spectroscopy (EDX). A dry SD100GV detector (manufactured by JEOL Ltd.) is used as an EDX detector, and a Noran System 7 (manufactured by Thermo Fisher Scientific K.K.) is used as an analyzer.

<Measurement of Volume Resistivity of Fine Particle>

Volume resistivity of the fine particle is measured as follows.

As a measurement device, a Model 6430 Sub-Femtoamp Remote SourceMeter (manufactured by Keithley Instruments) is used. A SH2-Z 4-terminal measurable sample holder (manufactured by Bio-Logic) is connected to a FORCE terminal of the measurement device, 0.2 g of fine particles as sample are placed on an electrode portion, and a distance between electrodes is measured using a torque wrench in a state in which a load of 123.7 kgf is applied thereto.

A resistance value at the time of applying a voltage of 20 V to the sample for 1 minute is measured, and volume resistivity is calculated using the following Equation (4).

$$\text{Volume resistivity}(\Omega\cdot\text{cm})=R/L \quad (4)$$

(R: resistance value (Ω), L: distance (cm) between electrodes)

<Confirmation of Structure of Organosilicon Condensate in Toner>

[Separation Method of Tetrahydrofuran (THF) Insoluble Matter of Toner Particle for NMR Measurement]

Tetrahydrofuran (THF) insoluble matter of the toner particle is separated as follows.

After 10.0 g of the toner particles are weighed, placed in a cylindrical filter paper (No. 86R, manufactured by Toyo Roshi Kaisha, Ltd.), and subjected to extraction with a Soxhlet extractor for 20 hours using 200 ml of THF as a solvent. Then, the filtrate in the cylindrical filter paper is vacuum-dried at 40° C. for several hours to obtain the THF-insoluble matter of the toner particle for NMR measurement. Further, in the present disclosure, when the organic fine particles or inorganic fine particles is externally added to the surface of the toner particle, the organic fine particles or inorganic fine particles are removed by the following method, thereby obtaining the toner particle.

A concentrated sucrose solution is prepared by adding 160 g of sucrose (manufactured by KISHIDA CHEMICAL Co., Ltd.) to 100 mL of ion-exchange water and dissolving the sucrose in a hot water bath. A dispersion is prepared by adding 31.0 g of the concentrated sucrose solution and 6 mL of Contaminon N (a 10 mass % aqueous solution of a neutral detergent for washing a precision measuring instrument, consisting of a nonionic surfactant, an anion surfactant, and an organic binder, having a pH of 7, manufactured by Wako Pure Chemical Industries, Ltd.). After adding 1.0 g of toner to the dispersion, a lump of the toner is removed using a spatula, or the like.

A centrifugal separation tube is shaken using a shaker at 350 spm (strokes per min) for 20 minutes. After shaking, the solution is transferred to a glass tube (50 mL) for swing rotor, and separation is performed using a centrifugal separator at 3500 rpm for 30 minutes. A state in which the toner and the aqueous solution are sufficiently separated from each other is confirmed by the naked eyes, and the toner separated in an uppermost layer is collected using a spatula, or the like. The collected toner is filtered using a vacuum filter and dried for 1 hour or more using a dryer. The dried product is disintegrated with a spatula, thereby obtaining the toner particles.

(Confirmation Method of Structure Represented by Formula (1))

A structure of a portion represented by Formula (1) in the organosilicon condensate contained in the toner particle is confirmed by the following method.

Presence or absence of an alkyl group, an alkenyl group, an aryl group, an acyl group, acryloxyalkyl group, or a methacryloxyalkyl group represented by Rb in Formula (1) is confirmed by $^{13}$C-NMR. Further, a detailed structure of Formula (1) is confirmed by $^{1}$H-NMR, $^{13}$C-NMR, and $^{29}$Si-NMR. Used devices and measurement conditions are described below.

(Measurement Conditions)

Instrument: AVANCE III 500 (manufactured by BRUKER)
Probe: 4 mm MAS BB/1H
Measurement temperature: room temperature
Sample rotation rate: 6 kHz
Sample: 150 mg of the measurement sample (THF-insoluble matter of the toner particle for NMR measurement) is put into a sample tube having a diameter of 4 mm.

In this method, presence or absence of the alkyl group, the alkenyl group, the aryl group, the acyl group, acryloxyalkyl group, or the methacryloxyalkyl group represented by Rb in Formula (1) can be confirmed. When a signal is confirmed, the structure of Formula (1) is indicated as "presence".

(Measurement conditions of $^{13}$C-NMR (Solid))

Measurement nuclear frequency: 125.77 MHz
Reference substance: Glycine (external reference: 176.03 ppm)
Observation width: 37.88 kHz
Measurement method: CP/MAS
Contact time: 1.75 ms
Repetition time: 4 s
Number of accumulation: 2048 times
LB Value: 50 Hz (Measurement method of $^{29}$Si-NMR (solid))

(Measurement conditions)

Instrument: AVANCE III 500 (manufactured by BRUKER)
Probe: 4 mm MAS BB/1H
Measurement temperature: room temperature
Sample rotation rate: 6 kHz
Sample: 150 mg of the measurement sample (THF-insoluble matter of the toner particle for NMR measurement) is put into a sample tube having a diameter of 4 mm.
Measurement nuclear frequency: 99.36 MHz
Reference substance: DSS (external reference: 1.534 ppm)
Observation width: 29.76 kHz
Measurement method: DD/MAS, CP/MAS
$^{29}$Si 90° pulse width: 4.00 μs at 1 dB
Contac time: 1.75 ms to 10 ms
Repetition time: 30 s (DD/MASS), 10 s (CP/MAS)
Number of accumulation: 2048 times
LB value: 50 Hz <Amount of Organosilicon Condensate in Toner>

An amount of the organosilicon condensate in the toner is evaluated by the following method.

The organosilicon condensate is measured using a wavelength dispersive X-ray fluorescence spectrometer "Axios" (manufactured by PANalytical) and a dedicated software "SuperQ ver.4.0F" (manufactured by PANalytical) attached thereto in order to set measurement conditions and analyze measurement data. Further, as an anode of X-ray tube, Rh is used, a measurement atmosphere is vacuum, a measurement diameter (collimator mask diameter) is 27 mm, and the measurement time is 10 seconds. Further, for measuring light elements, a proportional counter (PC) is used for detection. For measuring heavy elements, a scintillation counter (SC) is used for detection.

A pellet formed to have a thickness of 2 mm and a diameter of 39 mm by charging 4 g of the toner into a dedicated aluminum ring for pressing, leveling the surface of the toner, and compressing the toner with a tablet-forming compressor "BRE-32" (manufactured by Maekawa Testing Machine MFG. Co., Ltd.) at 20 MPa for 60 seconds is used as a measurement sample.

A fine silica ($SiO_2$) powder (0.5 parts by mass) is added to 100 parts by mass of the toner particles which do not contain the organosilicon condensate, and the mixture is sufficiently mixed using a coffee mill. Similarly, 5.0 parts by mass and 10.0 parts by mass of the fine silica powder are mixed with two sets of the toner particles, and the resultants are used as samples for a calibration curve.

Each of the samples is formed into a pellet for the sample of a calibration curve using the tablet-forming compressor as described above, and a counting rate (unit: cps) of Si-Kα rays observed at a diffraction angle (2θ) of 109.08° when pentaerythritol (PET) is used as an analyzing crystal is measured. Here, an accelerating voltage and current of the X-ray generator are 24 kV and 100 mA, respectively. A calibration curve of a primary function is obtained from the obtained counting rate of the X-ray on a vertical axis and an amount of $SiO_2$ added to each of the samples for a calibration curve on a horizontal axis.

Next, an analysis target toner is formed into a pellet using a tablet-forming compressor as described above, and a counting rate of Si-Kα rays is measured. The amount of the organosilicon condensate in the toner is determined from the calibration curve. Further, in the case of the sample to which the silica particle is added, the added silica particle is considered to be entirely contained in the toner, and a value obtained by subtracting an amount of the added silica particle from the obtained amount of the organosilicon condensate is considered as an amount of the organosilicon condensate.

<Measurement of Weight-Average Particle Diameters (D4) of Toner/Toner Particles/Toner Base Particles>

Weight-average particle diameters (D4) and number-average particle diameters (D1) of the toner, and the like, are calculated as follows. As a measurement device, a precision particle size distribution analyzer having a 100 μm aperture tube by an aperture impedance method, "Coulter Counter Multisizer 3" (trademark, manufactured by Beckman Coulter, Inc.) is used. Dedicated software included therewith "Beckman Coulter Multisizer 3 Version 3.51" (manufactured by Beckman Coulter, Inc.) is used for setting measurement conditions and analyzing measurement data. Further, measurement is performed with the number of effective measurement channels of 25,000.

As an aqueous electrolyte solution used in the measurement, an aqueous solution obtained by dissolving special grade sodium chloride in ion-exchange water so as to have a concentration of 1 mass %, e.g., "ISOTON II" (trade name, manufactured by Beckman Coulter, Inc.) can be used.

In addition, before the measurement and the analysis, the dedicated software is set as described below.

In the "Change standard operation method (SOMME)" screen of the dedicated software, a total count number in control mode is set to 50000 particles, the number of measurements is set to 1, and a Kd value is set to a value obtained using "standard particles 10.0 μm" (manufactured by Beckman Coulter, Inc.). A threshold value and a noise level are automatically set by pressing a "threshold/noise level measurement button". Further, a current is set to 1600 μA, a gain is set to 2, and the electrolyte solution is set to ISOTON II. Then, "flushing of aperture tube after measurement" is checked.

In the "conversion setting of pulse to particle diameter" screen of the dedicated software, a bin interval is set to the logarithmic particle diameter, a particle diameter bin is set to 256 particle diameter bins, and a particle diameter range is set to the range of from 2 μm to 60 μm.

A specific measurement method is as follows.

(1) A 250 mL round bottom glass beaker exclusive for Multisizer 3 is charged with 200 mL of the aqueous electrolyte solution, and then placed on a sample stand. Then, a stirrer rod is rotated counterclockwise at 24 revolutions per second. Soiling and air bubbles in the aperture tube are removed using an "Aperture flushing" function of the dedicated software.

(2) A 100 mL flat bottom glass beaker is charged with 30 mL of the aqueous electrolyte solution. Into the aqueous electrolyte solution, 0.3 mL of a diluted solution is added in which "Contaminon N" (a 10 mass % aqueous solution of a neutral detergent for washing a precision measuring instrument, consisting of a nonionic surfactant, an anion surfactant, and an organic binder, having a pH of 7, manufactured by Wako Pure Chemical Industries, Ltd.) as a dispersant is diluted 3-fold by mass with ion-exchange water.

(3) An ultrasonic wave disperser "Ultrasonic Dispersion System Tetra 150" (trade name, manufactured by Nikkaki-Bios Co., Ltd.) in which two oscillators having an oscillation frequency of 50 kHz are embedded in a phase-shifted state at 180 degrees, and which has an electrical output of 120 W is prepared. A water tank of the ultrasonic wave disperser is charged with 3.3 L of ion-exchange water, and 2 mL of Contaminon N is added to the water tank.

(4) The beaker in the section (2) is placed in a beaker-holding hole in the ultrasonic wave disperser, and the ultrasonic wave disperser is actuated. A height position of the beaker is adjusted so that a resonance state of a liquid level of the aqueous electrolyte in the beaker is highest.

(5) In a state where the aqueous electrolyte solution in the beaker in the section (4) is irradiated with ultrasonic waves, 10 mg of the toner is added in a small portion to the aqueous electrolyte and is dispersed. The ultrasonic dispersion treatment is further continued for 60 seconds. During the ultrasonic dispersion, a water temperature of the water tank is controlled to be 10° C. or more and 40° C. or less.

(6) The aqueous electrolyte solution in the section (5) in which the toner is dispersed is added dropwise using a pipette to the round bottom beaker in the section (1) placed on the sample stand, and then a measurement concentration is adjusted to be 5%. Then, the measurement is performed until the number of measured particles reaches 50,000.

(7) The measured data are analyzed by the dedicated software attached to the spectrometer, thereby calculating the weight-average particle diameter (D4) and the number-average particle diameter (D1). The weight-average particle diameter (D4) is an "average diameter" on the "analysis/volume statistics (arithmetic mean)" screen in the setting of graph/vol % in the dedicated software. The number-average particle diameter (D1) is an "average diameter" on the "analysis/number statistics (arithmetic mean)" screen in the setting of graph/number % in the dedicated software.

According to the present disclosure, the toner having excellent development durability, high chargeability, and excellent overcharge suppression performance under a low temperature and low humidity environment can be provided.

EXAMPLE

The present disclosure is more specifically described with reference to the following Examples. However, the present disclosure is not limited thereto. Hereinafter, toner particles and a preparation method of a toner will be described.

Unless otherwise specified, "part(s)" and "%" in Examples and Comparative Examples are all based on mass.

<Preparation Example of Organosilicon Solution>

| | |
|---|---|
| Ion-exchange water | 70.0 parts |
| Methyltriethoxysilane | 30.0 parts |

The above-mentioned materials were weighed in a 200 mL beaker, and a pH of the mixed solution was adjusted to 3.5 using 10% hydrochloric acid while confirming the pH using a pH meter (trade name: D-74, manufactured by Horiba Ltd.) mounted with an electrode (trade name: 9615S-10D manufactured by Horiba Ltd.). Thereafter, the mixed solution was heated to 60° C. in a water bath and stirred for 1.0 hour, thereby preparing an organosilicon compound solution 1. Further, organosilicon compound solutions 2 to 7 were prepared in the same manner except for changing the kind of organosilicon compound as illustrated in Table 1. Further, thereafter, the pH was measured using the pH meter and the electrode.

TABLE 1

| | Organosilicon compound | Abbreviation |
|---|---|---|
| Organosilicon compound solution 1 | Methyltriethoxysilane | MTES |
| Organosilicon compound solution 2 | Vinyltrimethoxysilane | VTMS |
| Organosilicon compound solution 3 | Isobutyltrimethoxysilane | iBTMS |
| Organosilicon compound solution 4 | n-hexyltrimethoxysilane | HTMS |
| Organosilicon compound solution 5 | Tetramethoxysilane | TMOS |
| Organosilicon compound solution 6 | n-decyltrimethoxysilane | DTMS |
| Organosilicon compound solution 7 | Dimethyldimethoxysilane | DMDMS |

<Preparation Example of Resin Fine Particle Dispersion>

<Resin Fine Particle Dispersion 1>

| | |
|---|---|
| Styrene | 59.5 parts |
| n-butyl acrylate | 7.7 parts |
| 2-acrylamide-2-methylpropane sulfonic acid | 2.8 parts |

The above mentioned materials were dissolved in 42.0 parts of dimethylformamide, and stirred for 1.0 hour with nitrogen bubbling, and then heated to 110° C. As an initiator, a mixed solution of 2.1 parts of tert-butylperoxyisopropyl monocarbonate (trade name: perbutyl I, manufactured by NOF Corporation) and 37.0 parts of toluene was added to this reaction solution. Again, a reaction was carried out at 110° C. for 4.0 hours. Then, the resultant was cooled and added dropwise to 1,000.0 parts of methanol, thereby obtaining a precipitate. The obtained precipitate was poured and dissolved in 120.0 parts of tetrahydrofuran, and added dropwise to 1,800 parts of methanol to precipitate a white precipitate, followed by filtering and drying at 90° C. under reduced pressure, thereby obtaining a resin 1.

After 200.0 parts of methylethylketone was put into a reactor equipped with a stirrer, a condenser, a thermometer, and a nitrogen inlet tube, 100.0 parts of the resin 1 was added thereto and dissolved therein. Then, after 1.0 mol/L aqueous potassium hydroxide solution was slowly added thereto and stirred for 10 minutes, 500.0 parts of ion-exchange water was slowly added dropwise to perform emulsification.

The obtained emulsion was distilled under reduced pressure to remove the solvent and ion-exchange water was added thereto so as to have a resin concentration of 20.0%, thereby obtaining a resin fine particle dispersion 1 in which the resin fine particle 1 containing a resin having an ionic functional group was dispersed. A number-average particle diameter of the resin fine particles 1 was 100 nm.

<Resin Fine Particle Dispersion 2>

A resin fine particle dispersion 2 in which a resin fine particle 2 containing a resin having an ionic functional group was dispersed was obtained in the same manner as in Preparation Example of the resin fine particle dispersion 1 except for using methacrylic acid instead of 2-acrylamide-2-methylpropane sulfonic acid in the Preparation Example of the resin fine particle dispersion 1. A number-average particle diameter of the resin fine particle 2 was 100 nm.

<Preparation Example of Toner Base Particle Dispersion>

(Preparation of Aqueous Medium B1)

| | |
|---|---|
| Ion-exchange water | 390.0 Parts |
| Sodium phosphate (dodecahydrate) | 14.0 parts |

The above-mentioned materials were put into a reactor, and warmed to 65° C. for 1.0 hours while purging with nitrogen.

An aqueous medium containing a dispersion stabilizer was prepared by adding an aqueous calcium chloride solution in which 9.2 parts of calcium chloride dehydrate was dissolved in 10.0 parts of ion-exchange water thereto at once while stirring the mixture at 12,000 rpm using the following disperser.

Disperser: T. K. Homomixer (trade name, manufactured by Tokushu Kika Kogyo Co., Ltd.)

In addition, 10% hydrochloric acid was added to the aqueous medium, and a pH was adjusted to 6.0, thereby obtaining an aqueous medium B1.

<Toner Base Particle Dispersion 1>

(Preparation Example of Polymerizable Monomer Composition)

| | |
|---|---|
| Styrene | 60.0 parts |
| Colorant (C.I. pigment blue15:3) | 6.5 parts |

The above-mentioned materials were put into an attritor (manufactured by NIPPON COKE & ENGINEERING CO., LTD.) and dispersed at 220 rpm for 5.0 hours using zirconia particles having a diameter of 1.7 mm, thereby preparing a colorant dispersion B1 in which the colorant was dispersed.

The following materials were added to the colorant dispersion B1.

| | |
|---|---|
| Styrene | 20.0 parts |
| n-butylacrylate | 20.0 parts |
| Polyester resin B1 (Tg: 75° C., acid value: 8.0 mgKOH/g) (Condensate of bisphenol A propylene oxide adduct/terephthalic acid/trimellitic acid) | 5.0 parts |
| Fischer-Tropsch wax (melting point: 78° C.) | 7.0 parts |

The above-mentioned materials were warmed to 65° C. and uniformly dissolved and dispersed at 500 rpm using a T.K. homomixer, thereby preparing a polymerizable monomer composition B1.

(Granulation Process)

The polymerizable monomer composition B1 was added to the aqueous medium B1 while a temperature of the aqueous medium B1 was maintained to 70° C. and the number of revolution of a stirring device was maintained to 12,000 rpm, and 9.0 parts of t-butyl peroxypivalate as a polymerization initiator was added thereto. The mixture was granulated for 10 minutes while the number of revolutions of the stirring device was maintained to 12,000 rpm as it was.

(Polymerization Process)

A high-speed stirring device was replaced with a stirrer equipped with propeller stirring blades. Then, polymerization was performed for 5.0 hours under stirring at 150 rpm and maintaining a temperature at 70° C., and then, a polymerization reaction was performed by raising a temperature to 85° C. and heating for 2.0 hours. A toner base particle dispersion 1 in which the toner base particle 1 was dispersed was obtained by adding ion-exchange water thereto, and adjusting a concentration of the toner base particle in the dispersion to be 20.0%. A weight-average particle diameter (D4) of the toner base particles 1 was 6.7 μm, a number-average particle diameter (D1) thereof is 5.9 μm, and a glass transition temperature (Tg) thereof was 56° C.

<Toner Base Particle Dispersion 2>

(Preparation Example of Resin Fine Particle Dispersion)

The following materials were weighed, mixed, and dissolved.

| | |
|---|---|
| Styrene | 80.0 parts |
| n-butylacrylate | 18.5 parts |
| Acrylic acid | 1.5 parts |

A 10% aqueous solution of a surfactant (trade name: Neogen RK, manufactured by DKS Co. Ltd.) was added to and dispersed in this solution. While the dispersion was slowly stirred again for 10 minutes, an aqueous solution obtained by adding 0.15 parts of potassium persulfate to 10.0 parts of ion-exchange water was added thereto. After purging with nitrogen, emulsion polymerization was performed at 70° C. for 6.0 hours. After the polymerization was terminated, the reaction solution was cooled to room temperature, and ion-exchange water was added thereto, thereby obtaining a resin fine particle dispersion B1 having a solid content of 12.5%.

(Preparation Process of Wax Dispersion)

The following materials were weighed and mixed with each other.

| | |
|---|---|
| Fischer-Tropsch wax (melting point: 78° C.) | 100.0 parts |
| Surfactant (trade name: Neogen RK, manufactured by DKS Co. Ltd.) | 15.0 parts |
| Ion-exchange water | 385.0 parts |

The mixture was dispersed for 1 hour using a wet jet mill (trade name: Nano Jet Pal JN100, manufactured by JOKOH Co., LTD.), thereby obtaining a wax dispersion B1. A concentration of the wax in the wax dispersion B1 was 20.0%.

(Preparation Process of Colorant Dispersion)

The following materials were weighed and mixed with each other.

| | |
|---|---|
| Colorant (C.I. pigment blue 15:3) | 100.0 parts |
| Surfactant (trade name: Neogen RK, manufactured by DKS Co. Ltd.) | 15.0 parts |
| Ion-exchange water | 885.0 parts |

The above-mentioned materials were dispersed for 1 hour using a wet jet mill (trade name: Nano Jet Pal JN100, manufactured by JOKOH Co., LTD.), thereby obtaining a colorant dispersion B2.

(Preparation Process of Toner Base Particle Dispersion)

| | |
|---|---|
| Resin fine particle dispersion B1 | 160.0 parts |
| Wax dispersion B1 | 10.0 parts |
| Colorant dispersion B2 | 10.0 parts |
| Magnesium sulfate | 0.2 parts |

After the above-mentioned materials were put into a reactor and dispersed using a homogenizer (trade name: Ultra-turrax T50, manufactured by IKA Corp.), the mixture was heated to 65° C. under stirring. After the mixture was stirred at 65° C. for 1.0 hour, at the time of observing the mixture using an optical microscope, it was confirmed that aggregate particles having a number-average particle diameter of 6.0 μm were formed. After adding 2.2 parts of the surfactant (trade name: Neogen RK, manufactured by DKS Co. Ltd.) thereto, a temperature was raised to 80° C., and the mixture was stirred for 2.0 hours, thereby obtaining fused spherical toner base particles. After cooling, a filtered and separated solid was stirred and washed with 720.0 parts of ion-exchange water for 1.0 hour. A solution containing the toner base particles was filtered, and dried using a vacuum drier, thereby obtaining toner base particles 2. A weight-average particle diameter (D4) of the toner base particles 2 was 7.1 μm, a number-average particle diameter (D1) thereof was 6.4 μm, and a glass transition temperature (Tg) thereof was 58° C.

After 100.0 parts of the toner base particle 2 was put into the aqueous medium B1, the toner base particle 2 was dispersed at 60° C. for 15 minutes using a T.K. homomixer while rotating the mixture at 5,000 rpm. A toner base particle dispersion 2 was obtained by adding ion-exchange water thereto and adjusting a concentration of the toner base particle in the dispersion to 20.0%.

<Toner Base Particle Dispersion 3>

| | |
|---|---|
| Ion-exchange water | 660.0 parts |
| 48.5% aqueous sodium dodecyl diphenyl ether disulfonate solution | 25.0 parts |

The above-mentioned materials were put into a reactor, mixed, and stirred using a T.K. homomixer at 10,000 rpm, thereby preparing an aqueous medium B2.

The following materials were added to 500.0 parts of ethylacetate, and dissolved at 100 rpm using a propeller-type stirring device, thereby preparing a solution.

| | |
|---|---|
| Styrene acrylic resin B1 (Tg: 60° C., acid value: 8.0 mgKOH/g) (Copolymer of styrene/n-butylacrylate (80.0/20.0)) | 100.0 parts |
| Polyester resin B1 (Tg: 75° C., acid value: 8.0 mgKOH/g) (Condensate of bisphenol A propylene oxide adduct/terephthalic acid/trimellitic acid) | 5.0 parts |

-continued

| | |
|---|---|
| Colorant (C.I. pigment blue 15:3) | 6.5 parts |
| Fischer-Tropsch wax (melting point: 78° C.) | 7.0 parts |

Next, 150.0 parts of the aqueous medium B2 was put into a reactor and the mixture was stirred at 12,000 rpm using a T.K. homomixer. Then, 100.0 parts of the above-mentioned solution was added thereto and mixed for 10 minutes, thereby preparing a resin particle dispersion B1.

Thereafter, 100.0 parts of the resin particle dispersion B1 was put into a flask equipped with a degassing pipe, a stirrer, and a thermometer. While the mixture was stirred at a peripheral stirring speed of 20 m/min, the mixture underwent desolvation at 30° C. for 12.0 hours under reduced pressure, and the mixture was aged at 45° C. for 4.0 hours. After aging, vacuum filtration was performed thereon, and the resultant was washed with 300.0 parts of ion-exchange water. The resultant was dried at 45° C. for 48.0 hours, and passed through a mesh (mesh size: 75 μm), thereby obtaining toner base particles 3. A weight-average particle diameter (D4) of the toner base particles 3 was 6.9 μm, a number-average particle diameter (D1) thereof was 6.2 μm, and a glass transition temperature (Tg) thereof was 55° C.

After 100.0 parts of the toner base particle 3 was put into the aqueous medium B1, the toner base particle 3 was dispersed at 60° C. for 15 minutes using a T.K. homomixer while rotating the mixture at 5,000 rpm. A toner base particle dispersion 3 was obtained by adding ion-exchange water thereto and adjusting a concentration of the toner base particle in the dispersion to 20.0%.

<Toner Base Particle Dispersion 4>

| | |
|---|---|
| Low-density polyethylene (melting point: 100° C.) | 20.0 parts |
| Styrene | 64.0 parts |
| n-butylacrylate | 13.5 parts |
| Acrylonitrile | 2.5 parts |

The above-mentioned materials were put into an autoclave, and a system was purged with nitrogen ($N_2$). Then, the mixture was heated and stirred, and a temperature was maintained at 180° C. After 50.0 parts of a xylene solution of 2.0% t-butyl hydroperoxide was continuously added dropwise to the system for 4.5 hours and cooled, a solvent was removed, thereby obtaining a graft polymer B1 in which a copolymer was grafted to polyethylene.

| | |
|---|---|
| Styrene acrylic resin B2 (Tg: 60° C., acid value: 8.0 mgKOH/g) (Copolymer of styrene/butyl acrylate/methacrylic acid = 80.0/18.5/1.5) | 100.0 parts |
| Fischer-Tropsch wax (melting point: 78° C.) | 7.0 parts |
| Graft polymer B1 | 5.0 parts |
| Colorant (C.I. pigment blue 15:3) | 6.5 parts |

The above-mentioned materials were well-mixed with each other using a Henschel mixer (FM-75 type, manufactured by Mitsui Miike Chemical Engineering Machinery, Co., Ltd.), and then melt-kneaded using a twin-screw kneader (PCM-30 type, manufactured by Ikegai Ironworks Corp.) of which a temperature was set to 100° C. The obtained kneaded product was cooled and coarsely ground using an atomizer mill (TAP-1 type, manufactured by Tokyo Atomizer M.F.G. Co., Ltd.) so as to have a diameter of not more than 1 mm, thereby obtaining a coarsely ground product. Next, the obtained coarsely ground product was finely pulverized using a turbo mill (T-250 type, manufactured by Turbo Kogyo Co., Ltd.) so as to have a diameter of about 5.5 μm. The fine powders were cut using a gas stream type classifier, thereby obtaining toner base particles 4. A weight-average particle diameter (D4) of the toner base particle 4 was 6.4 μm, a number-average particle diameter (D1) thereof was 5.4 μm, and a glass transition temperature (Tg) thereof was 59° C.

After 100.0 parts of the toner base particle 4 was put into the aqueous medium B1, the toner base particle was dispersed at 60° C. for 15 minutes using a T.K. homomixer while rotating the mixture at 5,000 rpm. A toner base particle dispersion 4 was obtained by adding ion-exchange water thereto and adjusting a concentration of the toner base particle in the dispersion to 20.0%.

<Toner Base Particle Dispersion 5>

A toner base particle dispersion 5 in which toner base particle 5 were dispersed was obtained in the same manner as in the Preparation Example of the toner base particle dispersion 4 except for using the following styrene acrylic acid resin B3 instead of the styrene acrylic acid resin B2 in the Preparation Example of the toner base particle dispersion 4.

Styrene acrylic acid resin B3: methacrylic acid in the styrene acrylic acid resin B2 was replaced with 2-acrylamide-2-methylpropane sulfonic acid A weight-average particle diameter (D4) of the toner base particles 5 was 6.2 μm, a number-average particle diameter (D1) thereof was 5.2 μm, and a glass transition temperature (Tg) thereof was 59° C.

<Toner Base Particle Dispersion 6>

A toner base particle dispersion 6 in which a toner base particles 6 were dispersed was obtained in the same manner as in the Preparation Example of the toner base particle dispersion 4 except for using the following styrene acrylic acid resin B4 instead of the styrene acrylic acid resin B2 in the Preparation Example of the toner base particle dispersion 4.

Styrene acrylic acid resin B4: methacrylic acid in the styrene acrylic acid resin B2 was replaced with butyl acrylate A weight-average particle diameter (D4) of the toner base particles 6 was 6.3 μm, a number-average particle diameter (D1) thereof was 5.3 μm, and a glass transition temperature (Tg) thereof was 58° C.

<Preparation Example of Toner Particle>

<Toner Particle 1>

The following samples were weighed in a reactor, and mixed with each other using propeller stirring blades.

| | |
|---|---|
| Organosilicon compound solution 1 | 20.0 parts |
| Medium-resistance inorganic fine particle (alumina, number-average particle diameter: 16 nm) | 0.2 parts |
| Silica fine particle (prepared by water-glass method, number-average particle diameter: 80 nm) | 2.0 parts |
| Toner base particle dispersion 1 | 500.0 parts |

Next, after the mixed solution was mixed using the propeller stirring blades and a pH of the mixed solution was adjusted to 5.5, a temperature was raised to 70° C. and maintained for 3.0 hours. Thereafter, the pH was adjusted to 9.5 using a 1.0 mol/L aqueous NaOH solution, and the mixed solution was maintained for 2.0 hours under stirring. The pH was adjusted to 1.5 using 10% hydrochloric acid, and the mixed solution was stirred for 1.0 hour. After that, the mixed solution washed with ion-exchange water, and filtered, thereby obtaining a toner particles 1 having inorganic fine particles having a surface coated with an organosilicon condensate.

<Toner Particles 2 to 10 and 13 to 28>

Toner particles 2 to 10 and 13 to 28 were prepared in the same manner as in the preparation method of the toner particle 1 except for changing the kind and an amount of organosilicon compound, the kind and an amount of fine particle, and the kind of toner base particle as illustrated in Table 2 in the preparation method of the toner particle 1.

<Toner Particle 11>

The following samples were weighed in a reactor, and mixed with each other using propeller stirring blades.

| | |
|---|---|
| Resin fine particle dispersion 1 | 20.0 parts |
| Toner base particle dispersion 1 | 500.0 parts |

Then, a pH of the mixed solution was adjusted to 5.5. After a temperature of the mixed solution was adjusted to 70° C., the mixed solution was maintained for 1.0 hour while being mixed using the propeller stirring blades.

Thereafter, 50.0 parts of the organosilicon compound solution 1 was added thereto, and a pH was adjusted to 8.3 using a 1.0 mol/L aqueous NaOH solution. Again, after maintaining the mixed solution for 4 hours under stirring, the mixed solution was air-cooled to 25° C.

After adding dilute hydrochloric acid to the obtained mixed solution to adjust a pH to 1.5 and stirring the mixed solution for 2 hours, the resultant was filtered, washed, and dried, thereby obtaining toner particles 11 having resin fine particles having an organosilicon condensate on a surface thereof.

<Toner Particle 12>

Toner particles 12 were obtained in the same manner as in the Preparation Example of the toner particle 11 except for using the resin fine particle dispersion 2 instead of the resin fine particle dispersion 1 in the Preparation Example of the toner particle 11.

<Toner Particle 29>

A pH of the toner base particle dispersion 1 was adjusted to 1.5 using 10% hydrochloric acid, and the resultant was stirred for 1.0 hour, washed with ion-exchange water, and filtered, thereby obtaining toner particles 29.

<Toner Particle 30>

The following samples were weighed in a reactor, and mixed with each other using propeller stirring blades.

| | |
|---|---|
| Methyltriethoxysilane | 6.0 parts |
| Silica fine particle (prepared by water-glass method, number-average particle diameter: 80 nm) | 2.0 parts |
| Toner base particle dispersion 1 | 500.0 parts |

Next, after the mixed solution was mixed using the propeller stirring blades and a pH of the mixed solution was adjusted to 5.5, a temperature was raised to 70° C. and maintained for 3.0 hours. Thereafter, the pH was adjusted to 9.5 using a 1.0 mol/L aqueous NaOH solution, and the solution was maintained for 2.0 hours under stirred. The pH was adjusted to 1.5 using 10% hydrochloric acid, and the mixed solution was stirred for 1.0 hour. Then, the resultant was filtered while being washed with ion-exchange water, thereby obtaining toner particles 30.

<Preparation Example of Toner>

<Toners 1 to 28 and 34>

As toners 1 to 28, the toner particles 1 to 28 were used as they were. As a toner 34, the toner particle 30 was used as it was.

In observation of a cross section of each of one particle of the toner using a transmission electron microscope (TEM), in each one toner particle of the toners 1 to 10 and 13 to 27, a signal indicating that a surface of an inorganic fine particle (alumina, titania, or strontium titanate) was covered with an Si atom was observed. Therefore, this result indicates that the surface of the inorganic fine particle (alumina, titanium titania, or strontium titanate) was coated with an organosilicon condensate. Further, in each one toner particle of the toners 1 to 10 and 15 to 27, it was confirmed that a surface of a silica fine particle was coated with the organosilicon condensate.

In observation of the cross section of each of the each one toner particle of toners using the transmission electron microscope (TEM), in each of one particle of the toners 11 and 12, a signal indicating that a surface of a resin fine particle was covered with an Si atom was not observed in an interface between a resin fine particle containing a resin having an ionic functional group and a toner base particle. Therefore, this result indicates that the resin fine particle comes in contact with the toner base particle without intervention of a condensate of the organosilicon compound.

<Toner 29>

(Preparation Process of Medium-Resistance Inorganic Fine Particle Dispersion)

| | |
|---|---|
| Medium-resistance inorganic fine particle (titania, number-average particle diameter: 30 nm) | 10.0 parts |
| Ion-exchange water | 45.0 parts |
| Methanol | 45.0 parts |

The above-mentioned materials were mixed with each other and dispersed for 5.0 hours using a ball mill filled with zirconia balls having a diameter of 4 mm, thereby obtaining a medium-resistance inorganic fine particle dispersion.

(Preparation Process of Toner)

After adding 100 parts of the toner particle 29 to 900 parts of a mixed solution of ion-exchange water and methanol (30/70), dispersion was performed using an ultrasonic wave disperser. While 5.0 parts of the medium-resistance inorganic fine particle dispersion was added thereto and stirred, 33 parts of a 0.4% methanol solution of stearylamine acetate was added dropwise thereto. Thereafter, the mixed solution was heated at 50° C. for 1.0 hour under stirring. Here, 1.0 part of the organosilicon compound solution 1 was added, and heated and stirred at 50° C. for 5.0 hours. Then, the resultant was subjected to suction filtration, thereby obtaining a powder. The obtained powder was re-dispersed in 300 parts of a mixed solution of ion-exchange water and methanol (50/50). After this dispersion was stirred at 20° C. for 30 minutes and subjected to suction filtration, the resultant was dried under reduced pressure at 50° C. for 5.0 hours, thereby obtaining a toner 29. In the toner 29, a signal indicating that a surface of an inorganic fine particle was covered with an Si atom was not observed in an interface between a toner base particle and the inorganic fine particle (titania). Therefore, this result indicates that the surface the inorganic fine particle (titania) was not coated with an organosilicon condensate.

<Toner 30>

A toner 30 was obtained in the same manner as in the Preparation Example of the toner 29 except that the kind of medium-resistance inorganic fine particle was changed to alumina (number-average particle diameter: 16 nm), an addition amount of the medium-resistance inorganic fine particle dispersion was changed to 20.0 parts, and an addition amount of the organosilicon compound solution 1 was changed to 6.0 parts in the Preparation Example of the toner 29. In the toner 30, a signal indicating that a surface of an inorganic fine particle was covered with an Si atom was not observed in an interface between a toner base particle and the inorganic fine particle (alumina). Therefore, this result indicates that the surface the inorganic fine particle (alumina) was not coated with an organosilicon condensate.

<Toner 31>

A toner 31 was obtained in the same manner as in the Preparation Example of the toner 30 except that the medium-resistance inorganic fine particle dispersion was not used in the Preparation Example of the toner 30.

<Toner 32>

A toner 32 was obtained by mixing 2.0 parts of alumina fine particles (number-average particle size: 16 nm) treated with hexamethyldisilazane with 100.0 parts of the toner 31 using a Henschel mixer (manufactured by Mitsui Miike Chemical Engineering Machinery, Co., Ltd.).

<Toner 33>

A toner 33 was obtained by mixing the following materials with 100.0 parts of the toner particle 29 using a Henschel mixer (manufactured by Mitsui Miike Chemical Engineering Machinery, Co., Ltd.).

| | |
|---|---|
| Alumina fine particles (number-average particle size: 16 nm) treated with hexamethyldisilazane | 0.2 parts |
| Silica fine particles (number-average particle size: 80 nm) treated with hexamethyldisilazane | 2.0 parts |

Charge attenuation of each of the toners was measured. A charge attenuation constant was calculated from the charge attenuation measurement results. Physical properties of each of the toners were illustrated in Table 3.

TABLE 2

| Toner particle No. | Organosilicon compound solution No. | Compound | Amount (parts) | Toner base particle dispersion No. | Medium-resistance fine particle Kind | Volume resistivity (Ω · cm) | Number-average particle diameter (nm) | amount (parts) | Silica fine particle amount (parts) |
|---|---|---|---|---|---|---|---|---|---|
| 1 | 1 | MTES | 20.0 | 1 | Alumina | $2.4 \times 10^{7}$ | 16 | 0.2 | 2.0 |
| 2 | 1 | MTES | 20.0 | 1 | Alumina | $2.4 \times 10^{7}$ | 16 | 2.0 | 2.0 |
| 3 | 1 | MTES | 10.0 | 1 | Alumina | $2.4 \times 10^{7}$ | 16 | 0.05 | 2.0 |
| 4 | 1 | MTES | 20.0 | 1 | Alumina | $2.4 \times 10^{7}$ | 16 | 0.03 | 2.0 |
| 5 | 1 | MTES | 20.0 | 1 | Alumina | $2.4 \times 10^{7}$ | 16 | 0.02 | 2.0 |
| 6 | 2 | VTMS | 20.0 | 1 | Alumina | $2.4 \times 10^{7}$ | 16 | 0.2 | 2.0 |
| 7 | 2 | VTMS | 20.0 | 1 | Titania | $1.8 \times 10^{8}$ | 5 | 0.2 | 2.0 |
| 8 | 2 | VTMS | 20.0 | 1 | Titania | $1.8 \times 10^{8}$ | 30 | 0.2 | 2.0 |
| 9 | 2 | VTMS | 20.0 | 1 | Titania | $1.8 \times 10^{8}$ | 500 | 0.2 | 2.0 |
| 10 | 2 | VTMS | 20.0 | 1 | Strontium titanate | $1.4 \times 10^{10}$ | 35 | 0.2 | 2.0 |
| 13 | 1 | MTES | 20.0 | 1 | Alumina | $2.4 \times 10^{7}$ | 16 | 2.0 | — |
| 14 | 2 | VTMS | 20.0 | 1 | Alumina | $2.4 \times 10^{7}$ | 16 | 2.0 | — |
| 15 | 2 | VTMS | 20.0 | 2 | Alumina | $2.4 \times 10^{7}$ | 16 | 0.2 | 2.0 |
| 16 | 2 | VTMS | 20.0 | 3 | Alumina | $2.4 \times 10^{7}$ | 16 | 0.2 | 2.0 |
| 17 | 2 | VTMS | 20.0 | 4 | Alumina | $2.4 \times 10^{7}$ | 16 | 0.2 | 2.0 |
| 18 | 2 | VTMS | 20.0 | 5 | Alumina | $2.4 \times 10^{7}$ | 16 | 0.2 | 2.0 |
| 19 | 2 | VTMS | 20.0 | 6 | Alumina | $2.4 \times 10^{7}$ | 16 | 0.2 | 2.0 |
| 20 | 3 | iBTMS | 20.0 | 1 | Alumina | $2.4 \times 10^{7}$ | 16 | 0.2 | 2.0 |
| 21 | 4 | HTMS | 20.0 | 1 | Alumina | $2.4 \times 10^{7}$ | 16 | 0.2 | 2.0 |
| 22 | 1 | MTES | 10.0 | 1 | Alumina | $2.4 \times 10^{7}$ | 16 | 0.2 | 2.0 |
| | 5 | TMOS | 10.0 | | | | | | |
| 23 | 1 | MTES | 6.7 | 1 | Alumina | $2.4 \times 10^{7}$ | 16 | 0.05 | 2.0 |
| 24 | 1 | MTES | 3.3 | 1 | Alumina | $2.4 \times 10^{7}$ | 16 | 0.05 | 2.0 |
| 25 | 5 | TMOS | 20.0 | 1 | Alumina | $2.4 \times 10^{7}$ | 16 | 0.2 | 2.0 |
| 26 | 6 | DTMS | 20.0 | 1 | Alumina | $2.4 \times 10^{7}$ | 16 | 0.2 | 2.0 |
| 27 | 7 | DMDMS | 20.0 | 1 | Alumina | $2.4 \times 10^{7}$ | 16 | 0.2 | 2.0 |
| 28 | 1 | MTES | 20.0 | 1 | Silver | $1.5 \times 10^{-6}$ | 20 | 0.2 | 2.0 |

In Table 2, the abbreviations in Table 1 were used for the organic silicon compound names. As the silica fine particle, a silica fine particle similar to the silica fine particle (prepared by the water-glass method, number-average particle diameter: 80 nm) in Preparation Example of the toner particle 1 was used.)

TABLE 3

| Toner | Organosilicon condensate | Organosilicon compound | Structure of Formula (1) | Amount of Organic Si (wt %) | Charge Attenuation Constant | Organosilicon condensate-containing fine particle | Volume resistivity of fine particle (Ω · cm) | Ionic functional group | D4 (μm) | D1 (μm) |
|---|---|---|---|---|---|---|---|---|---|---|
| 1 | Presence | MTES | Presence | 1.9 | $4.8 \times 10^{-2}$ | Presence | $2.4 \times 10^{7}$ | — | 6.8 | 6.0 |
| 2 | Presence | MTES | Presence | 1.7 | $1.1 \times 10^{-1}$ | Presence | $2.4 \times 10^{7}$ | — | 6.9 | 6.1 |
| 3 | Presence | MTES | Presence | 0.7 | $1.5 \times 10^{-2}$ | Presence | $2.4 \times 10^{7}$ | — | 6.8 | 6.0 |
| 4 | Presence | MTES | Presence | 1.9 | $8.0 \times 10^{-2}$ | Presence | $2.4 \times 10^{7}$ | — | 6.7 | 5.9 |
| 5 | Presence | MTES | Presence | 2.0 | $4.0 \times 10^{-3}$ | Presence | $2.4 \times 10^{7}$ | — | 6.7 | 5.9 |

TABLE 3-continued

| Toner | Organosilicon condensate | Organosilicon compound | Structure of Formula (1) | Amount of Organic Si (wt %) | Charge Attenuation Constant | Organosilicon condensate-containing fine particle | Volume resistivity of fine particle (Ω · cm) | Ionic functional group | D4 (μm) | D1 (μm) |
|---|---|---|---|---|---|---|---|---|---|---|
| 6 | Presence | VTMS | Presence | 2.2 | $5.0 \times 10^{-2}$ | Presence | $2.4 \times 10^{7}$ | — | 6.9 | 6.1 |
| 7 | Presence | VTMS | Presence | 2.0 | $2.0 \times 10^{-2}$ | Presence | $1.8 \times 10^{8}$ | — | 6.8 | 6.0 |
| 8 | Presence | VTMS | Presence | 2.0 | $1.8 \times 10^{-2}$ | Presence | $1.8 \times 10^{8}$ | — | 6.8 | 6.0 |
| 9 | Presence | VTMS | Presence | 1.9 | $1.5 \times 10^{-2}$ | Presence | $1.8 \times 10^{8}$ | — | 6.7 | 5.9 |
| 10 | Presence | VTMS | Presence | 1.8 | $8.5 \times 10^{-3}$ | Presence | $1.4 \times 10^{10}$ | — | 6.9 | 6.1 |
| 11 | Presence | VTMS | Presence | 2.0 | $5.8 \times 10^{-3}$ | Presence | — | sulfo group | 6.8 | 6.0 |
| 12 | Presence | VTMS | Presence | 2.0 | $1.2 \times 10^{-2}$ | Presence | — | carboxyl group | 6.8 | 6.0 |
| 13 | Presence | MTES | Presence | 1.9 | $4.7 \times 10^{-2}$ | Presence | $2.4 \times 10^{7}$ | — | 6.7 | 5.9 |
| 14 | Presence | VTMS | Presence | 1.8 | $5.0 \times 10^{-2}$ | Presence | $2.4 \times 10^{7}$ | — | 6.8 | 6.0 |
| 15 | Presence | VTMS | Presence | 2.2 | $3.4 \times 10^{-2}$ | Presence | $2.4 \times 10^{7}$ | — | 7.2 | 6.4 |
| 16 | Presence | VTMS | Presence | 2.0 | $1.7 \times 10^{-2}$ | Presence | $2.4 \times 10^{7}$ | — | 7.0 | 6.2 |
| 17 | Presence | VTMS | Presence | 2.0 | $1.4 \times 10^{-2}$ | Presence | $2.4 \times 10^{7}$ | — | 6.5 | 5.4 |
| 18 | Presence | VTMS | Presence | 1.9 | $8.2 \times 10^{-3}$ | Presence | $2.4 \times 10^{7}$ | — | 6.3 | 5.2 |
| 19 | Presence | VTMS | Presence | 1.6 | $4.0 \times 10^{-3}$ | Presence | $2.4 \times 10^{7}$ | — | 6.4 | 5.3 |
| 20 | Presence | iBTMS | Presence | 2.2 | $1.8 \times 10^{-2}$ | Presence | $2.4 \times 10^{7}$ | — | 6.9 | 6.1 |
| 21 | Presence | HTMS | Presence | 2.3 | $7.6 \times 10^{-3}$ | Presence | $2.4 \times 10^{7}$ | — | 6.9 | 6.1 |
| 22 | Presence | MTES TMOS | Presence | 2.0 | $3.2 \times 10^{-2}$ | Presence | $2.4 \times 10^{7}$ | — | 6.8 | 6.0 |
| 23 | Presence | VTMS | Presence | 0.3 | $4.9 \times 10^{-2}$ | Presence | $2.4 \times 10^{7}$ | — | 6.8 | 6.0 |
| 24 | Presence | VTMS | Presence | 0.1 | $5.2 \times 10^{-2}$ | Presence | $2.4 \times 10^{7}$ | — | 6.7 | 5.9 |
| 25 | Presence | TMOS | Presence | 1.8 | $4.8 \times 10^{-3}$ | Presence | $2.4 \times 10^{7}$ | — | 6.9 | 6.1 |
| 26 | Presence | DTMS | Presence | 2.3 | $4.6 \times 10^{-3}$ | Presence | $2.4 \times 10^{7}$ | — | 7.0 | 6.2 |
| 27 | Presence | DMDMS | Presence | 1.4 | $4.2 \times 10^{-3}$ | Presence | $2.4 \times 10^{7}$ | — | 7.2 | 6.1 |
| 28 | Presence | MTES | Presence | 2.0 | $1.0 \times 10^{1}$ | Presence | $1.0 \times 10^{-7}$ | — | 6.8 | 6.0 |
| 29 | Presence | MTES | Presence | 0.1 | $8.0 \times 10^{-4}$ | Presence | $1.8 \times 10^{8}$ | — | 7.0 | 6.2 |
| 30 | Presence | MTES | Presence | 1.8 | $2.0 \times 10^{-3}$ | Presence | $2.4 \times 10^{7}$ | — | 7.1 | 6.2 |
| 31 | Presence | MTES | Presence | 1.7 | $1.8 \times 10^{-3}$ | Absence | $2.4 \times 10^{7}$ | — | 7.0 | 6.1 |
| 32 | Presence | MTES | Presence | 1.8 | $2.1 \times 10^{-3}$ | Absence | $2.4 \times 10^{7}$ | | 7.0 | 6.1 |
| 33 | Absence | — | Absence | 0.0 | $2.0 \times 10^{-3}$ | Absence | $2.4 \times 10^{7}$ | — | 6.7 | 5.9 |
| 34 | Presence | MTES | Presence | 1.8 | $6.5 \times 10^{-4}$ | Presence | $1.8 \times 10^{8}$ | — | 6.8 | 6.0 |

In Table 3, in the column of the organosilicon condensate, a case where the organosilicon condensate was observed on the surface of the toner base particle in cross-sectional observation using the TEM was indicated as "presence", and a case where the organosilicon condensate was not observed as "absence".

In the column of the structure of Formula (1), a case where the structure of Formula (1) was confirmed was indicated as "presence", a case where the structure of Formula (1) was not confirmed was indicated as "absence", based on the method described in the article The column of the amount of organosilicon represents an amount (mass %) of the organosilicon condensate.

The abbreviations in Table 1 were used as organic silicon compound names.

Examples 1 to 27 and Comparative Examples 1 to 6

Overcharge suppression performance, chargeability, and a charge rising property of the toners 1 to 33 were evaluated. Evaluation results were illustrated in Table 4.

Hereinafter, evaluation methods and evaluation criteria in the present disclosure will be described.

As an image forming device, the following modified laser printer and process cartridge were used.

Modified laser printer obtained by modifying LBP-7700C (manufactured by Cannon Ltd.), a commercially available laser printer, so as to have a process speed of 240 mm/sec Toner cartridge 323 (Black) (manufactured by Cannon Inc.), a commercially available process cartridge After removing a product toner from a cartridge, the inside was cleaned by blowing with air. Then 150 g of each of toners 1 to 33 was filled therein. Further, evaluation was performed by removing respective product toners from respective stations of yellow, magenta, and cyan, and inserting respective cartridges of yellow, magenta, and cyan in which remaining toner sensing mechanism was invalidated were inserted.

<1. Evaluation of Overcharge Suppression Performance>

The process cartridge, the modified laser printer, and the following transfer paper were kept in a low temperature environment (temperature of 0° C./relative humidity of 10%) for 48 hours.

Transfer paper: GF-0081 (A4:81.4 g/m$^2$, manufactured by Cannon Inc.)

In the low temperature environment, an image with a printing ratio of 0.5% was continuously printed on 10,000 sheets of the transfer paper. Thereafter, a half-tone image (applied toner amount: 0.20 mg/cm$^2$) was printed on one sheet of the transfer paper. The printed image was observed by the naked eyes, and the presence or absence of density unevenness was confirmed. At the same time, a surface of a developing roller was observed by the naked eyes, such that a state of a toner layer on the developing roller was confirmed. Overcharge suppression performance was evaluated based on the following evaluation Criteria.

In a low temperature environment, overcharge easily occurred. When overcharge occurs, adhesion between a toner and a developing roller is increased, such that a control in a regulation blade may be difficult. Therefore, a toner layer on the developing roller is thickened, such that density unevenness may be generated on an image. In a case of a toner having excellent overcharge suppression performance, an excellent image may be obtained under the above-mentioned conditions.

(Evaluation Criteria of Overcharge Suppression Performance)

A: The toner layer on the developing roller was uniform, and there was no density unevenness in the image. The overcharge suppression performance was significantly excellent.

B: An end portion of the toner layer on the developing roller was slightly thickened, but there was no density unevenness in the image. The overcharge suppression performance was excellent.

C: Entirely, unevenness was slightly present in the toner layer on the developing roller, but there was no density unevenness in the image.

D: Entirely, unevenness was slightly present in the toner layer on the developing roller, and fine density unevenness was formed at an end portion of the image.

<2. Evaluation of Chargeability>

The process cartridge, the modified laser printer, the following printing paper, and the following evaluation paper were kept in a normal temperature and normal humidity environment (temperature of 25° C./relative humidity of 50% or less, referred to as an "N/N environment") for 48 hours.

Printing paper: GF-0081 (manufactured by Cannon Inc., A4: 81.4 g/m$^2$)

Evaluation Paper: Color Laser Photo Paper, glossy (manufactured by HP, Letter: 220 g/m$^2$)

(Initial Stage Under N/N)

An all-white image with a printing ratio of 0% was printed on the evaluation paper under the N/N environment.

(After Duration Under N/N)

Continuously, after an image with a printing ratio of 0.5% was continuously printed on 20,000 sheets of the printing paper under the N/N environment, the all-white image with a printing ratio of 0% was printed on the evaluation paper.

(After Keeping Under H/H)

Continuously, the process cartridge, the modified laser printer, and the evaluation paper after the printing were transferred and kept in a high temperature and high humidity environment (temperature of 30° C./relative humidity of 80% or less, referred to as an "H/H environment") for 48 hours. Continuously, the all-white image with a printing ratio of 0% was printed on the evaluation paper under the H/H environment.

A fog density on each full-white image was calculated and the chargeability was evaluated according to the following criteria. Calculated values and evaluation are illustrated in Table 4. A difference between whiteness of a white background portion (all-white image) of the evaluation paper and whiteness of the transfer paper measured using "white photometer TC-6DS" (manufactured by TokyoDenshoku. Co., Ltd.) was calculated, and taken as the fog density (%). As a filter, an amber filter was used.

It is known that when chargeability is decreased, a fog density on an image is increased. In a toner having excellent chargeability, it is possible to obtain a good image with a low fog density. Further, in the toner having excellent development durability, chargeability is hardly deteriorated even though the toner was used for a long period of time. Furthermore, in a toner of which a surface layer has a low hygroscopic property, chargeability is hardly deteriorated even in a high humidity environment.

(Evaluation Criteria of Chargeability)

A: The fog density was less than 0.5%

B: The fog density was 0.5% or more and less than 1.0%.

C: The fog density was 1.0% or more and less than 2.0%.

D: The fog density was 2.0% or more.

<3. Evaluation of Charge Rising Property>

The process cartridge, the modified laser printer, and the following evaluation paper were kept in a low temperature and low humidity environment (temperature of 15° C./relative humidity of 10% or less, referred to as an "L/L environment") for 48 hours.

Evaluation paper: GF-0081 (manufactured by Cannon Inc., A4: 81.4 g/m$^2$)

Under the L/L environment, an image having an all-black image portion 21, an all-white image portion 22, and a half-tone image portion 23 when the evaluation paper 20 was viewed vertically was printed on the evaluation sheet as illustrated in FIGURE.

All-black image portion 21: image portion (applied toner amount of 0.45 mg/cm$^2$) in the form of a horizontal band having a length of 10 mm between the position of 10 mm from the top of the paper to the position of 20 mm All-white image portion 22: image portion (applied toner amount of 0.00 mg/cm$^2$) having a length of 10 mm from a lower end of the all-black image portion 21 in a downstream direction Half-tone image portion 23: image portion (applied toner amount of 0.20 mg/cm$^2$) having a length of 100 mm from a lower end of the all-white image portion 22 in a downstream direction Based on a Difference Between an image density of a portion (a first measurement portion 24), which is a portion of the half-tone image portion 23, corresponding to a length (L) of an outer circumference of the developing roller from the all-black image portion 21 in the downstream direction, and an image density of a portion (a second measurement portion 25), which is a portion corresponding to the length (L) of the outer circumference of the developing roller from the all-white image portion 22 in the downstream direction, a charge rising property was evaluated according to the following criteria.

Measurement of the image density was performed by measuring a relative density of an image with respect to a white background having an image density of 0.00 using a Macbeth reflection densitometer (trade name: RD918, manufactured by Macbeth Co.) equipped with an amber filter according to the attached instruction manual. The obtained relative density was taken as the image density value of each of the measurement portions.

When the charge rising property is good, since the toner supplied onto a charging roller is quickly charged, a good image in which a difference between the image density of the first measurement portion 24 and the image density of the second measurement portion 25 is small can be obtained.

(Evaluation Criteria of Charge Rising Property)

A: The difference between the image densities was less than 0.03.

B: The difference between the image densities was 0.03 or more and less than 0.06.

C: The difference between the image densities was 0.06 or more and less than 0.10.

D: The difference between the image densities was 0.10 or more.

TABLE 4

| | Toner | Overcharge Suppression | Chargeability: Initial stage under N/N | | Chargeability: After Duration under N/N | | Chargeability: After keeping under H/H | | Charge rising property | |
|---|---|---|---|---|---|---|---|---|---|---|
| Example 1 | 1 | A | A | 0.2 | A | 0.2 | A | 0.2 | A | 0.01 |
| Example 2 | 2 | A | A | 0.2 | A | 0.2 | A | 0.2 | A | 0.01 |
| Example 3 | 3 | A | A | 0.2 | A | 0.2 | A | 0.2 | A | 0.01 |
| Example 4 | 4 | A | A | 0.2 | A | 0.2 | A | 0.2 | A | 0.01 |
| Example 5 | 5 | B | A | 0.2 | A | 0.2 | A | 0.2 | A | 0.02 |
| Example 6 | 6 | A | A | 0.2 | A | 0.2 | A | 0.2 | A | 0.01 |
| Example 7 | 7 | A | A | 0.3 | A | 0.4 | A | 0.4 | A | 0.01 |
| Example 8 | 8 | A | A | 0.3 | A | 0.4 | A | 0.4 | A | 0.01 |
| Example 9 | 9 | A | A | 0.3 | A | 0.4 | A | 0.4 | A | 0.01 |
| Example 10 | 10 | A | A | 0.3 | A | 0.4 | A | 0.4 | A | 0.02 |
| Example 11 | 11 | A | A | 0.2 | A | 0.4 | A | 0.4 | A | 0.01 |
| Example 12 | 12 | A | A | 0.2 | A | 0.4 | A | 0.4 | A | 0.01 |
| Example 13 | 13 | A | A | 0.3 | A | 0.4 | B | 0.6 | A | 0.02 |
| Example 14 | 14 | A | A | 0.3 | A | 0.4 | B | 0.6 | A | 0.02 |
| Example 15 | 15 | A | A | 0.2 | A | 0.3 | A | 0.3 | A | 0.01 |
| Example 16 | 16 | A | A | 0.3 | A | 0.3 | A | 0.4 | A | 0.02 |
| Example 17 | 17 | A | A | 0.3 | A | 0.3 | A | 0.4 | A | 0.02 |
| Example 18 | 18 | A | A | 0.3 | A | 0.4 | A | 0.4 | A | 0.02 |
| Example 19 | 19 | B | B | 0.5 | B | 0.7 | B | 0.9 | A | 0.02 |
| Example 20 | 20 | A | A | 0.2 | A | 0.3 | A | 0.3 | A | 0.02 |
| Example 21 | 21 | A | A | 0.3 | A | 0.4 | A | 0.4 | B | 0.04 |
| Example 22 | 22 | A | A | 0.2 | A | 0.2 | A | 0.4 | A | 0.01 |
| Example 23 | 23 | A | A | 0.3 | B | 0.7 | B | 0.9 | A | 0.01 |
| Example 24 | 24 | A | A | 0.4 | C | 1.2 | C | 1.6 | A | 0.01 |
| Example 25 | 25 | B | A | 0.2 | A | 0.4 | C | 1.2 | A | 0.02 |
| Example 26 | 26 | B | A | 0.3 | B | 0.7 | C | 1.1 | C | 0.06 |
| Example 27 | 27 | B | A | 0.4 | C | 1.2 | C | 1.6 | C | 0.08 |
| Comparative Example 1 | 28 | A | D | 3.8 | D | 5.2 | D | 6.4 | D | 0.23 |
| Comparative Example 2 | 29 | D | C | 1.3 | D | 2.1 | D | 2.4 | C | 0.08 |
| Comparative Example 3 | 30 | D | A | 0.3 | A | 0.4 | B | 0.6 | B | 0.05 |
| Comparative Example 4 | 31 | D | A | 0.2 | A | 0.3 | A | 0.4 | C | 0.07 |
| Comparative Example 5 | 32 | D | A | 0.3 | A | 0.4 | B | 0.6 | B | 0.05 |
| Comparative Example 6 | 33 | D | A | 0.4 | D | 2.2 | D | 2.4 | B | 0.04 |
| Comparative Example 7 | 34 | D | A | 0.3 | A | 0.4 | A | 0.4 | A | 0.02 |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-096354, filed May 15, 2018, which is hereby incorporated by reference herein in its entirety.

What is claimed is:

1. A toner comprising a toner particle, the toner particle comprising (i) a toner base particle containing a binder resin and (ii) a resin fine particle, wherein a surface of the toner base particle bears the resin fine particle, the resin fine particle has an organosilicon condensate on a surface thereof, the resin fine particle contains a resin having an ionic functional group, and a charge attenuation constant of the toner is $3.5\times10^{-3}$ to $1.0\times10^{0}$.

2. The toner according to claim 1, wherein the charge attenuation constant of the toner is $5.0\times10^{-3}$ to $1.0\times10^{0}$.

3. The toner according to claim 1, wherein the organosilicon condensate is a condensate of an organosilicon compound represented by Formula (1)

$$(Ra)_n—Si—(Rb)_{4-n} \quad (1)$$

where Ra is independently a halogen atom, a hydroxy group or an alkoxy group, Rb is independently an alkyl group, an alkenyl group, an aryl group, an acyl group, an acryloxyalkyl group or a methacryloxyalkyl group, and n is an integer of 2 to 4.

4. The toner according to claim 3, wherein the organosilicon compound is represented by Formula (2)

$$(Ra)_3—Si—(Rb)_1 \quad (2)$$

where Ra is independently a halogen atom, a hydroxy group or an alkoxy group, and Rb is an alkyl group, an alkenyl group, an aryl group, an acyl group, an acryloxyalkyl group or a methacryloxyalkyl group.

* * * * *